US008383313B2

(12) United States Patent
Ayaki et al.

(10) Patent No.: US 8,383,313 B2
(45) **Date of Patent: *Feb. 26, 2013**

(54) TONER

(75) Inventors: Yasukazu Ayaki, Yokohama (JP); Tsuneyoshi Tominaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/960,406

(22) Filed: Dec. 3, 2010

(65) Prior Publication Data

US 2011/0081609 A1 Apr. 7, 2011

Related U.S. Application Data

(60) Division of application No. 12/706,910, filed on Feb. 17, 2010, now Pat. No. 7,858,282, which is a continuation of application No. PCT/JP2009/067473, filed on Oct. 7, 2009.

(30) Foreign Application Priority Data

Oct. 7, 2008 (JP) ..... 2008-260351

(51) Int. Cl.
*G03G 9/093* (2006.01)

(52) U.S. Cl. ..... 430/110.2; 430/109.3; 430/111.4

(58) Field of Classification Search ..... 430/109.3, 430/110.2, 111.4
See application file for complete search history.

(56) References Cited

U.S. PATENT DOCUMENTS

| | | | | |
|---|---|---|---|---|
| 5,744,278 | A | 4/1998 | Ayaki et al. | |
| 6,342,328 | B1 | 1/2002 | Takasaki et al. | |
| 7,459,253 | B2 | 12/2008 | Abe et al. | |
| 7,858,282 | B2 * | 12/2010 | Ayaki et al. | 430/110.2 |
| 2008/0057434 | A1 | 3/2008 | Itoh | |
| 2009/0291380 | A1 | 11/2009 | Ayaki et al. | |
| 2009/0291383 | A1 | 11/2009 | Ayaki et al. | |

FOREIGN PATENT DOCUMENTS

| | | |
|---|---|---|
| EP | 2 249 208 A1 | 11/2010 |
| JP | 11-288129 | 10/1999 |
| JP | 2006-313302 | 11/2006 |
| JP | 2007-156297 | 6/2007 |
| JP | 2007-225917 | 9/2007 |
| JP | 2007-256720 | 10/2007 |
| JP | 2007-279666 | 10/2007 |
| JP | 2007-322499 | 12/2007 |
| JP | 2008-058620 | 3/2008 |
| JP | 2008-224939 | 9/2008 |

OTHER PUBLICATIONS

Robert Z. Greenley, "Q and e Values for Free Radical Copolymerizations of Vinyl Monomers and Telogens," Polymer Handbook, Third Edition, John Wiley & Sons, 1989, pp. 267-274.

European Search Report dated Oct. 18, 2012 in European Application No. 09819211.5.

* cited by examiner

*Primary Examiner* — Janis L Dote

(74) *Attorney, Agent, or Firm* — Fitzpatrick, Cella, Harper & Scinto

(57) ABSTRACT

Provided is a toner including toner particles each containing a binder resin, a colorant, and a wax, and inorganic fine particles, the toner having such a characteristic that a temperature-storage elastic modulus curve at a high frequency shows a characteristic change in its behavior in a specific temperature region with respect to a temperature-storage elastic modulus curve at a low frequency.

6 Claims, 4 Drawing Sheets

TONER

This application is a divisional of application Ser. No. 12/706,910, filed Feb. 17, 2010 now U.S. Pat. No. 7,858,282, which is a continuation of International Application No. PCT/JP2009/067473, filed Oct. 7, 2009. The contents of application Ser. No. 12/706,910 is incorporated herein by reference.

BACKGROUND OF THE INVENTION

1. Field of the Invention

The present invention relates to a toner for use in an electrophotographic method or a toner jet method.

2. Description of the Related Art

An electrophotographic method has been expected to satisfy various demands such as improvement in image quality, reductions in size and weight of an apparatus, attaining higher speed, and the reduction of energy consumption thereby, and an improvement in fixing performance of toner has been requested so as to satisfy those demands. In particular, an improvement in performance by which the toner can be fixed on a transfer material at a reduced temperature (hereinafter, referred to as "low-temperature fixability") has been requested.

However, when the low-temperature fixability of the toner is improved, performance by which the occurrence of an image failure is suppressed in continuous printing after the toner has been stored under a high-temperature, high-humidity environment over a long time period (hereinafter, referred to as "durable stability") is apt to reduce.

In a fixing step, performance by which offset as the following phenomenon is suppressed (hereinafter, referred to as "offset resistance") is apt to reduce, because after the toner on the transfer material has adhered to a fixing member, the transfer material is contaminated by additional migration of the toner to the transfer material. In addition, performance by which the color-developing performance of an image is improved through the formation of a high-gloss image (hereinafter, referred to as "gloss performance") and performance by which the occurrence of non-uniformity in the gloss of the image is suppressed (hereinafter, referred to as "penetration resistance") are apt to reduce.

Accordingly, a toner that simultaneously satisfies the above performances has been demanded.

JP 2007-322499 A and JP 2008-58620 A each aim to achieve compatibility between the low-temperature fixability of toner and the improvement of the stability in continuous printing of the toner by coating a core particle having a low glass transition point (Tg) with a shell layer having a high Tg so that the exudation of the core particle to the surface of the toner during the storage of the toner may be suppressed.

JP 2007-225917 A aims to achieve compatibility between the low-temperature fixability of toner and the improvement of the stability in continuous printing by controlling a ratio between storage elastic moduli G''s each serving as a rheology characteristic of a binder resin in the toner, the storage elastic moduli being obtained by performing dynamic viscoelasticity measurement for the toner at a temperature higher than the Tg of the binder resin by 35° C. and different frequencies.

SUMMARY OF THE INVENTION

Problems to be Solved by the Invention

A toner having additionally improved low-temperature fixability as compared to the toners described in the above documents has been demanded. However, when the achievement of an additional improvement in low-temperature fixability of toner is aimed, there arises such a problem that the above durable stability remarkably reduces. In addition, when the improvement of the durable stability of the toner is aimed, there arises such a problem that the offset resistance, gloss performance, and penetration resistance of the toner reduce.

The present invention is to provide a toner capable of solving such problems as described above.

That is, the present invention is to provide a toner containing a wax, the toner having the following characteristics such as even when its low-temperature fixability is improved, the toner has good durable stability, is excellent in offset resistance, gloss performance, and penetration resistance, and enables the formation of a high-quality image.

Means for Solving the Problems

The present invention relates to a toner, including: toner particles each containing at least a binder resin, a colorant, and a wax; and inorganic fine particles, in which: the toner has a local maximum A at a temperature of 60.0 to 135.0° C. and a local maximum B at a temperature of 35.0 to 85.0° C. in a (temperature-G'10/G'1) curve created by plotting a ratio (G'10/G'1) between a storage elastic modulus (G'1) at a frequency of 1 Hz and a storage elastic modulus (G'10) at a frequency of 10 Hz on a y axis and a temperature (° C.) at which the storage elastic moduli are measured on an x axis; and when a temperature at which the curve shows the local maximum A is represented by Ta (° C.) and a temperature at which the curve shows the local maximum B is represented by Tb (° C.), the Ta (° C.) is higher than the Tb (° C.), and a difference (Ta−Tb) (° C.) between the Ta (° C.) and the Tb (° C.) is 15.0 to 90.0° C., and a value (G'a) for the G'10/G'1 at the Ta (° C.) is 5.0 or more.

Effect of the Invention

According to the toner of the present invention, a toner containing a wax has the following characteristics such as even when its low-temperature fixability is improved, the toner has good durable stability, is excellent in offset resistance, gloss performance, and penetration resistance, and enables the formation of a high-quality image.

DESCRIPTION OF THE EMBODIMENTS

The inventors of the present invention have found that it is important for a toner of the present invention to have the following physical properties in order that compatibility among an improvement in low-temperature fixability of the toner, the suppression of a reduction in durable stability of the toner, and the formation of a high-quality image may be achieved.

That is, the toner of the present invention has a feature that a temperature-storage elastic modulus curve when dynamic viscoelasticity measurement for the toner is performed at a high frequency shows a characteristic change in its behavior in a specific temperature region with respect to a temperature-storage elastic modulus curve when the dynamic viscoelasticity measurement for the toner is performed at a low frequency.

Here, a method of measuring a dynamic viscoelasticity in the present invention is described below.

A sample obtained by the pressure molding of the toner under an environment having a temperature of 25° C. and a humidity of 60% RH with a tablet molder is used as a measurement sample. When the true density of the toner is represented by ρ (g/cm$^3$), 0.20×ρ (g) of the toner is weighed, and is molded into a cylindrical pellet having a diameter of 8 mm and a thickness of about 4 mm by applying a load of 20 kN to the toner for 2 minutes. The following measurement is performed with the pellet.

"ARES" (manufactured by Rheometric Scientific F.E. Ltd.) is used as a measuring apparatus and measurement is performed in accordance with an operating manual of the measuring device under the following measurement condition.

Geometry type: parallel plates
Parallel plates: serrated parallel plates are used.
Initial temperature: described hereinafter (TgT−10 (° C.))
Final temperature: 180 (° C.)
Change gap to match tool thermal expansion: on
Tool thermal expansion coefficient: 0.0 (μm/° C.)
Fluid density: 1.0 (g/cm$^3$)
Fixture compliance: 0.83 (μrad/g·cm)
Test type: dynamic temperature ramp
Frequency 1 Hz: 6.2832 (rad·s)
10 Hz: 62.832 (rad·s)
Ramp rate: 2.0 (° C./min)
Soak time after ramp: 1.0 (s)
Time per measure: 30.0 (s)
Strain: 0.02(%)
Automatic tension adjustment: on
Mode: apply constant static force
Automatic tension direction: compression
Initial static force: 10.0 (g)
Automatic tension sensitivity: 40.0 (g)
Operating condition of automatic tension (when sample modulus <): 1.00×10$^8$ (dyn/cm$^2$)
Automatic tension limits: default
Maximum automatic tension rate: 0.01 (mm/s)
Automatic strain: on
Maximum applied strain: 40.0(%)
Maximum allowed torque: 150.0 (g·cm)
Minimum allowed torque: 1.0 (g·cm)
Strain adjustment: 20.0(%)
Strain amplitude control: default behavior
Measurement option Default delay settings
Cycles: 0.5
Time: 3.0 (s)
Transducer: transducer 1

Figure 2:
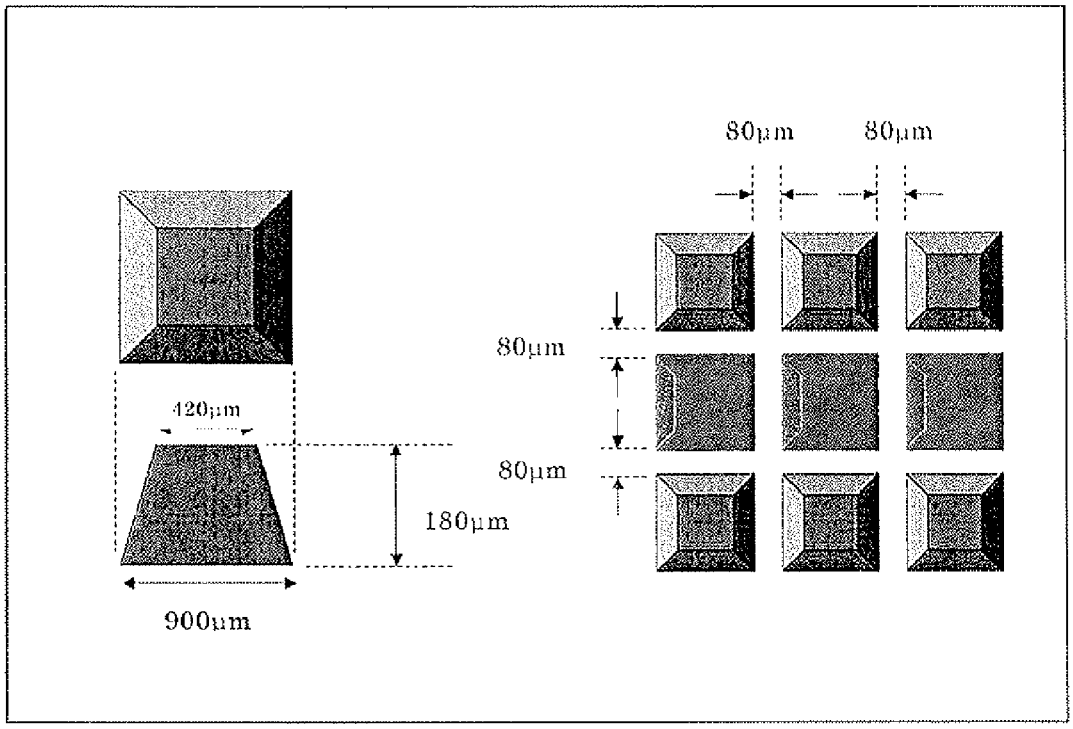
FIG. 2 is a conceptional view illustrating a surface profile of a serrated parallel plate for use in dynamic viscoelasticity measurement in the present invention.
Figure 3:
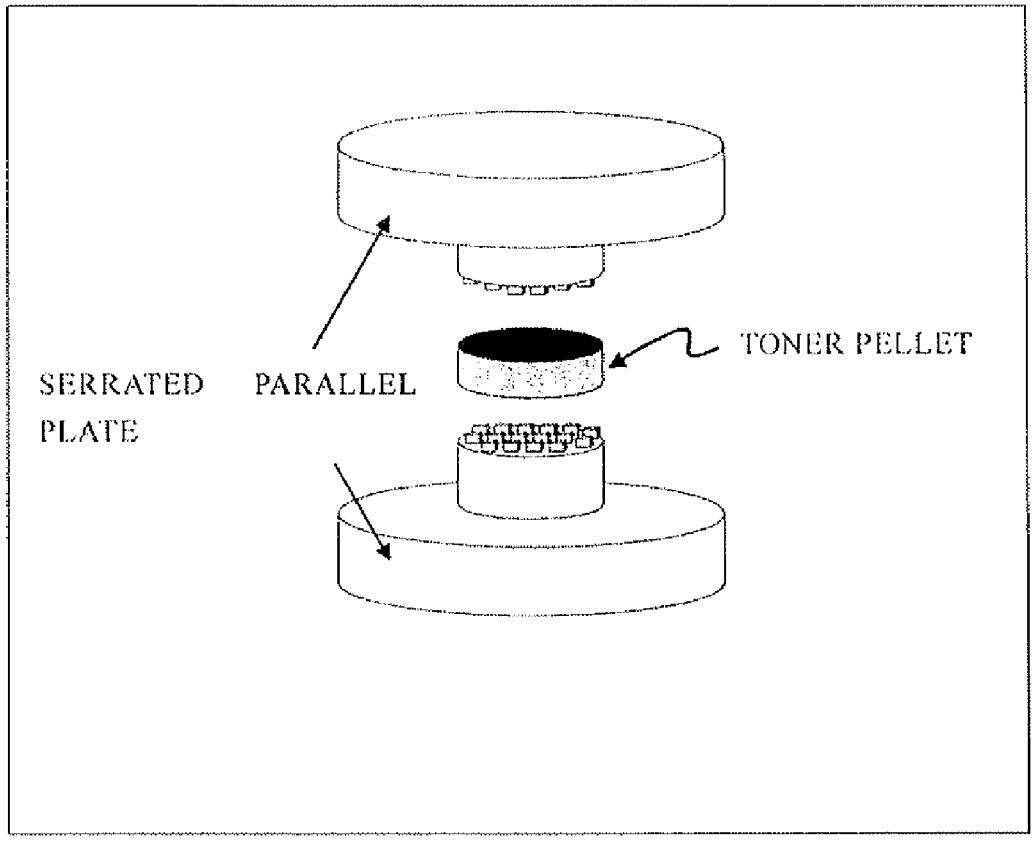
FIG. 3 is a conceptional view illustrating a positional relationship upon setting of a toner pellet in a dynamic viscoelasticity-measuring apparatus in the present invention.

FIG. 2 illustrates a conceptional view for the surface profile of a serrated parallel plate for use in the dynamic viscoelasticity measurement for the toner in the present invention. In addition, FIG. 3 illustrates a conceptional view illustrating a positional relationship upon setting of the toner pellet in a dynamic viscoelasticity-measuring apparatus.

Operations for the measurement are as described below.

<Pre-Operation>

The temperature in the sample chamber of the measuring apparatus is held at 25.0° C. in advance, and the pellet is set so that a load (axial force) may be 30. Then, a hold switch is turned on. The hold switch has a function of holding a load applied to the pellet at a value for the load when the switch is turned on by adjusting a distance between the plates between which the pellet is sandwiched (gap; a distance between protruded portions in both the plates). When the glass transition point (Tg) of the toner measured with a differential scanning calorimeter (DSC) to be described later is represented by TgT (° C.), the sample chamber is heated to a temperature of TgT+2 (° C.). When the temperature in the chamber stabilizes at the above temperature, the hold switch is turned off, and the distance (gap) between the plates is adjusted so that the load (axial force) applied to the pellet may be 1,500. Then, the hold switch is turned on again. With such procedure, the protruded portions of the serrated plates are gradually embedded in the surface of the pellet by the load, so the distance (gap) between the plates gradually reduces. The hold switch is turned off when the distance (gap) between the plates reduces by 10% as compared to the distance (gap) between the plates when the hold switch is turned on with the load set to 1,500. The distance between the plates is further expanded so that the load (axial force) applied to the pellet may be 150. In this case, attention should be paid to the point that the moving speed of each plate is made as low as possible so that the plate may move little by little. Attention should also be paid to the point that the load must not be much smaller than 150. The hold switch is turned on again when the load reaches 150, and the temperature in the sample chamber is set as the temperature at which the measurement is initiated. The temperature at which the measurement is initiated is set to TgT−10 (° C.)

In the above operation, the pellet is immobilized at a temperature of TgT+2 (° C.) for preventing the application of excessive heat to the toner. With such procedure, a change in state of presence of each of the binder resin, the wax, and any other additive in the toner due to heat before the initiation of the measurement can be suppressed, so the physical properties of the toner can be measured with improved accuracy.

<Measurement>

When the temperature in the sample chamber reaches, and stabilizes at, the temperature at which the measurement is initiated, the hold switch is turned off, and the distance (gap) between the plates at the time is input. Then, the measurement is initiated. The measurement is performed twice with two pellets for the cases of a measurement frequency of 1 Hz and a measurement frequency of 10 Hz.

A storage elastic modulus obtained for a measurement frequency of 1 Hz is represented by G'1 (Pa), and a storage elastic modulus obtained for a measurement frequency of 10 Hz is represented by G'10 (Pa). A (temperature-G'1) curve in which measurement temperatures are indicated by an x axis and the G'1 at each of the temperatures is indicated by a y axis and a (temperature-G'10) curve in which measurement temperatures are indicated by an x axis and the G'10 at each of the temperatures is indicated by a y axis are obtained.

Figure 4:
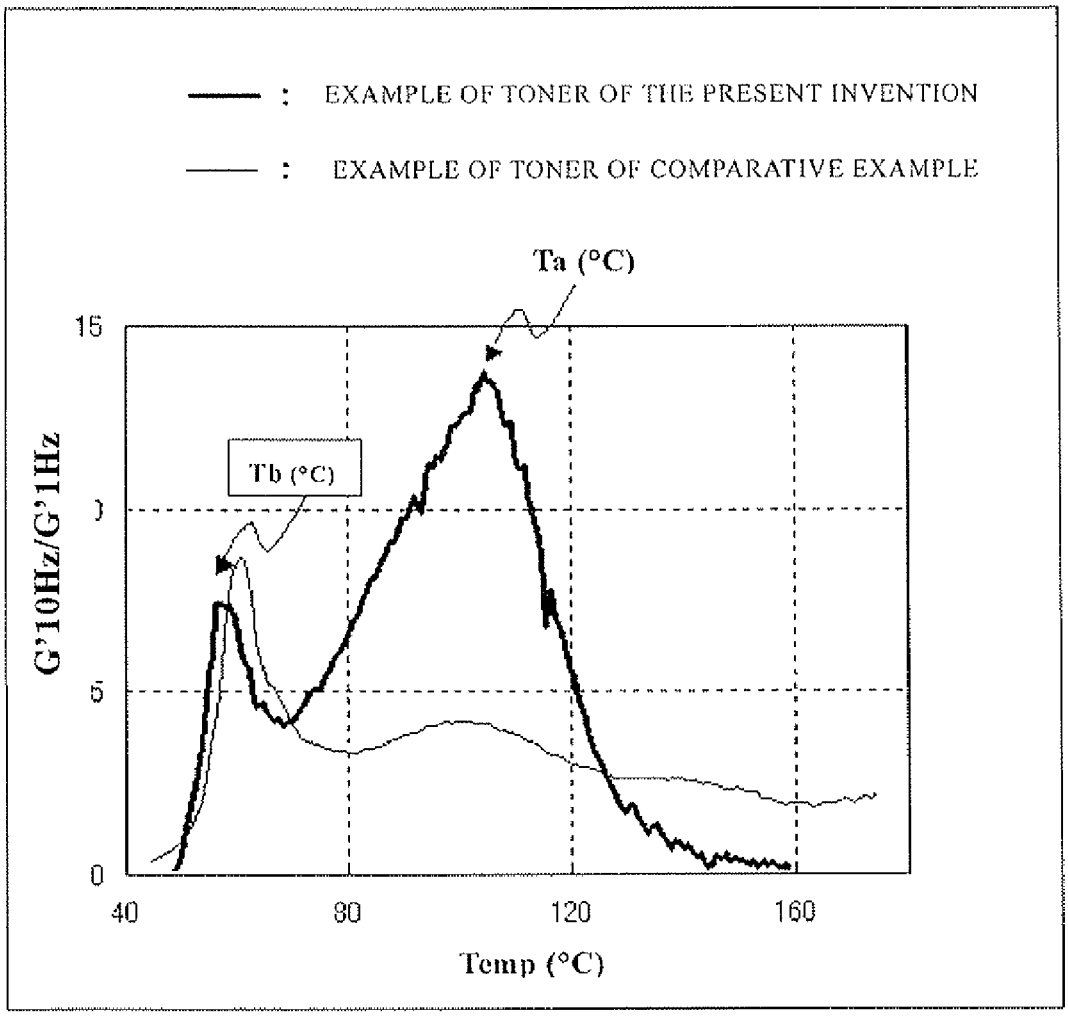
FIG. 4 is a view illustrating an example of the (temperature-G'10/G'1) curve of a toner according to any one of the examples and comparative examples of the present invention.

A (temperature-G'10/G'1) curve in which a y axis indicates a ratio (G'10/G' 1) between the G'1 and the G' 10 and an x axis indicates a measurement temperature is created from the resultant curves. A physical property value stipulated in the present invention is read out of the curve. FIG. 4 illustrates an example of the (temperature-G'10/G'1) curve of a toner according to any one of the examples and comparative examples of the present invention.

It should be noted that a rate of temperature increase is 2.0° C./min and a measurement interval is 30 seconds in the measurement of each of the G'1 and the G'10, so data on the storage elastic moduli in an increment of 1.0° C. can be obtained. However, temperatures in both the measurement at 1 Hz and the measurement at 10 Hz may slightly deviate from each other. In such case, the average of a measurement temperature at a frequency of 1 Hz and a measurement temperature at a frequency of 10 Hz is plotted as a measurement temperature. In addition, a fine, sharp peak may appear in the resultant (temperature-G'10/G'1) curve owing to an influence of measurement error, whereas a local maximum stipulated in the present invention is a local maximum in a large peak having some degree of a temperature width.

The above-mentioned object can be achieved when the toner of the present invention includes: toner particles each containing at least a binder resin, a colorant, and a wax; and inorganic fine particles, in which: the toner has a local maximum A at a temperature of 60.0 to 135.0° C. and a local maximum B at a temperature of 35.0 to 85.0° C. in the (temperature-G'10/G'1) curve; and when a temperature at which the curve shows the local maximum A is represented by Ta (° C.) and a temperature at which the curve shows the local maximum B is represented by Tb (° C.), the Ta is higher than the Tb, and a difference (Ta−Tb) (° C.) between the Ta and the Tb is 15.0 to 90.0° C., and a value (G'a) for the G'10/G'1 at the Ta is 5.0 or more.

When dynamic viscoelasticity measurement for a thermoplastic resin is performed, a temperature and a frequency generally correlate with each other. Measurement at a high frequency, i.e., increasing the rate at which the measurement sample deforms corresponds to measurement at a low temperature, and measurement at a low frequency, i.e., decreasing the rate at which the measurement sample deforms corresponds to measurement at a high temperature. Accordingly, when dynamic viscoelasticity measurement for a general toner is performed at a frequency of each of 1 Hz and 10 Hz, the (temperature-G'1) curve and the (temperature-G'10) curve are of substantially the same shape, and the (temperature-G'1) curve is in such a state that the (temperature-G'1) curve is shifted in a parallel fashion to higher temperatures by about 5 to 10° C. In this case, such a local maximum that the G'10/G'1 is 5.0 or more does not appear in the (temperature-G'10/G'1) curve in a high temperature region from 60.0 to 135.0° C.

The toner of the present invention has a characteristic that when the (temperature-G' 1) curve and the (temperature-G'10) curve are compared, the curves are of different shapes in the high temperature region from 60.0 to 135.0° C. That is, a portion where the G'10 is particularly large as compared to the G'1 is present in the high temperature region from 60.0 to 135.0° C. As a result, in the (temperature-G'10/G' 1) curve, a local maximum A (temperature at which the curve shows the local maximum A: Ta (° C.)) is detected.

Further, an effect of the present invention is favorably exerted when a change in behavior of the (temperature-G'10) curve in the high temperature region from 60.0 to 135.0° C. has intensity outstripping a certain range.

In the present invention, when the G'a is less than 5.0, the effect of the present invention cannot be obtained. When the G'10 (Pa) is excessively small as compared to the G'1 (Pa) at the Ta (° C.), the durable stability, offset resistance, and penetration resistance of the toner reduce. When the G'1 (Pa) is excessively large as compared to the G' 10 (Pa) at the Ta (° C.), the low-temperature fixability and gloss performance of the toner reduce. Accordingly, the G'a is preferably 6.0 or more, or more preferably 8.0 or more.

Meanwhile, such characteristic as described above is observed probably because the toner of the present invention has a thermodynamically hard portion and a thermodynamically soft portion, and it is not preferred that a difference in thermodynamic hardness between the portions be excessively large from the viewpoints of additional improvements in low-temperature fixability and durable stability of the toner. Accordingly, the G'a is preferably 5.0 to 20.0, more preferably 5.0 to 15.0, or still more preferably 6.0 to 14.0, and the G'a particularly preferably ranges from 8.0 to 14.0.

In addition, when the temperature Ta at which the curve shows the local maximum A is lower than 60.0° C., the offset resistance, penetration resistance, and durable stability of the toner reduce. When the Ta exceeds 135.0° C., the low-temperature fixability and gloss performance of the toner reduce. In addition, when the toner has a portion that is excessively hard in a thermal sense, the toner is apt to be brittle, so the durable stability of the toner may reduce. Accordingly, the Ta is 60.0 to 135.0° C., preferably 65.0 to 135.0° C., or more preferably 70.0 to 130.0° C., and the Ta particularly preferably ranges from 80.0 to 125.0° C.

When the temperature Tb at which the curve shows the local maximum B is lower than 35.0° C., the toner becomes excessively soft, so the penetration resistance and durable stability of the toner cannot be sufficiently obtained. When the Tb exceeds 85.0° C., the toner becomes excessively hard, so the low-temperature fixability and gloss performance of the toner cannot be sufficiently obtained. Accordingly, the Tb is 35.0 to 85.0° C., preferably 45.0 to 80.0° C., or more preferably 50.0 to 80.0° C., and the Tb particularly preferably ranges from 50.0 to 75.0° C.

When the (Ta−Tb) is lower than 15.0° C., the hard portion and soft portion of the toner have excessively close thermodynamic characteristics, so the durable stability of the toner cannot be sufficiently obtained in the case where the improvement of the low-temperature fixability of the toner is tried. The low-temperature fixability of the toner reduces in the case where the improvement of the durable stability of the toner is tried. When the (Ta−Tb) exceeds 90.0° C., the hard portion and soft portion of the toner largely differ from each other in thermodynamic characteristics, so the durable stability of the toner cannot be sufficiently obtained. Accordingly, the (Ta−Tb) is 15.0 to 90.0° C., preferably 15.0 to 85.0° C., or more preferably 20.0 to 82.0° C., and the (Ta−Tb) particularly preferably ranges from 30.0 to 82.0° C.

The Ta (° C.), the Tb (° C.), and the G'a can be controlled by the kinds and addition amounts of, for example, the binder resin and the wax in each toner particle, the addition of a resin different in nature from the binder resin, and uniformity in the contents of those materials in the toner and uniformity in the states of presence of the materials in the toner.

Potential methods of causing the toner to exert such characteristic physical properties as described above include methods each relating to the constitution of a toner particle, such as a method involving coating a soft core phase with a hard shell phase and a method involving coating a hard core phase with a soft shell phase. Of those, the former method is preferred. However, when dynamic viscoelasticity measurement is performed by mixing a resin b having a certain glass transition point (Tg) and a resin a having a Tg higher than that of the resin b, in a state where the resin a and the resin b are compatible with each other, no change in behavior corresponding to the Tg of the resin a or b is generally detected. A change in behavior corresponding to a Tg intermediate between the Tg of the resin a and the Tg of the resin b is detected irrespective of whether a condition for the dynamic viscoelasticity measurement is 1 Hz or 10 Hz. Accordingly, only one local maximum is observed when a (temperature-G'10/G'1) curve is created. On the other hand, in a state where the resin a and the resin b undergo a complete phase separation, behavior corresponding to the Tg of the resin b and behavior corresponding to the Tg of the resin a are detected irrespective of whether the condition for the dynamic viscoelasticity measurement is 1 Hz or 10 Hz. However, comparison between the (temperature-G'1) curve and the (temperature-G'10) curve shows that the curves are of substantially the same shape, so only a local maximum corresponding to the Tg of the resin b is generally observed when the (temperature-G'10/G'1) curve is created. Alternatively, even when a local maximum corresponding to the Tg of the resin a is observed, the G'a is extremely small.

Accordingly, even when each toner particle has such core-shell structure as described above, such characteristic physical properties as described above may not be exerted just because the toner particle has a general core-shell structure.

That is, the toner of the present invention is in a state where part of a core phase and part of a shell phase are compatible with each other, and is hence assumed to be of a two-layer structure formed of the core phase and a phase in which a core component and a shell component with which the core phase is coated are compatible with each other, or a three-layer structure formed of the two-layer structure and a shell phase with which the two-layer structure is coated.

When the toner has any such constitution as described above, the shell phase synchronizes with the behavior of the core phase for a measurement condition corresponding to a relatively low frequency such as a frequency of 1 Hz, i.e., low-speed distortion, so the nature of the shell phase may be inconspicuous. Accordingly, only the physical properties of the core phase as a main component for the toner are detected in the (temperature-G'1) curve. On the other hand, the core phase and the shell phase cannot synchronize with each other for a measurement condition corresponding to a high frequency such as a frequency of 10 Hz, i.e., high-speed distortion, so the physical properties of the core phase and the shell phase may be detected.

Further, the G'a has a large value of 5.0 or more probably because a state where the core phase is coated with the shell phase is uniform among the toner particles, that is, the contents of the binder resin as a main component for the core phase and a shell resin with which the core phase is coated as materials in each toner particle are uniform among the toner particles, and a state where the binder resin and the shell resin are compatible with each other is uniform among the toner particles.

When comparison between the content of the shell resin of one of the toner particles and a similar content of another one of the particles shows that the contents largely deviate from each other, physical property behavior corresponding to the shell phase is hardly detected at a frequency of 10 Hz. Accordingly, the G'a has a small value. In addition, when a state where the core phase and the shell phase are compatible with each other in each toner particle is non-uniform among the particles, physical property behavior corresponding to the shell phase is hardly detected at a frequency of 10 Hz, so the G'a has a small value. On the other hand, when the amount in which the core phase is coated with the shell phase is increased while a state where the core phase is coated with the shell phase is non-uniform among the particles, physical property behavior corresponding to the shell phase is easily detected at a frequency of 10 Hz, but the entirety of the toner becomes hard, so physical property behavior corresponding to the shell phase is also easily detected at a frequency of 1 Hz. Accordingly, the G'a may similarly have a small value.

That is, the G'a may be an index of uniformity for the entirety of the toner when a state where the core-shell structure is formed of one of the toner particles and a similar state of another one of the particles are compared with each other.

In addition, the Tb (° C.) may be a value corresponding to the glass transition point (Tg) of the binder resin of the toner. The Ta (° C.) may be a value corresponding to the Tg and addition amount of the shell resin, and to the state where the shell resin and the binder resin are compatible with each other.

The toner of the present invention preferably has a difference (G'a−G'b) between a value (G'b) for the G'10/G'1 at the Tb (° C.) and the G' a of 1.0 to 15.0. The (G' a−G'b) represents a difference in extent of a change in thermal behavior between the core phase and the shell phase. When the extent of a change in thermal behavior of the G'a is substantially identical to that of the G'b or the extent of the change in thermal behavior of the G'a is larger than that of the G'b, the low-temperature fixability and durable stability of the toner become better. In addition, the offset resistance, gloss performance, and penetration resistance of the toner also tend to be good. When the (G'a−G'b) is less than 1.0, a change in thermal behavior of the core phase is more remarkable than that of the shell phase, so the durable stability and penetration resistance of the toner may reduce in the case where the improvement of the low-temperature fixability of the toner is aimed. In addition, the low-temperature fixability and gloss performance of the toner may reduce in the case where the improvement of the durable stability of the toner is aimed. When the (G'a−G'b) exceeds 15.0, the difference in extent of a change in thermal behavior between the core phase and the shell phase is remarkable, so the low-temperature fixability, durable stability, and gloss performance of the toner may reduce. Accordingly, the (G'a−G'b) is more preferably 1.5 to 10.0, or still more preferably 4.0 to 8.0.

It should be noted that the above (G'a−G'b) can be controlled by the kinds and addition amounts of, for example, the binder resin and the wax in each toner particle, the addition of a resin different in nature from the binder resin, and uniformity in the contents of those materials in the toner and uniformity in the states of presence of the materials in the toner.

The toner of the present invention preferably has a value (G'1Ta) for the G'1 at the Ta (° C.) of 1,000 to 300,000 Pa. When the G'1Ta falls within the above range in the toner having a G'a of 5.0 or more, the low-temperature fixability, development stability, gloss performance, and penetration resistance of the toner become better. When the G'1Ta is less than 1,000 Pa, the development stability, offset resistance, and penetration resistance of the toner may reduce. When the G'1Ta exceeds 300,000 Pa, the low-temperature fixability and gloss performance of the toner may reduce. Accordingly, the G'1Ta is more preferably 2,000 to 100,000 Pa, or still more preferably 2,000 to 50,000 Pa.

It should be noted that the above G'1Ta can be controlled by the kinds and addition amounts of, for example, the binder resin and the wax in each toner particle, the addition of a resin different in nature from the binder resin, and uniformity in the contents of those materials in the toner and uniformity in the states of presence of the materials in the toner.

It is preferred that the toner of the present invention has, in a molecular weight distribution in terms of polystyrene (PSt) obtained by gel permeation chromatography (GPC) for tetrahydrofuran (THF) soluble matter of the toner, a peak molecular weight [most frequent molecular weight] (Mp) at a molecular weight of 5,000 to 30,000, a weight-average molecular weight (Mw) of 6,000 to 200,000, and a ratio (Mw/Mn) between the weight-average molecular weight (Mw) and a number-average molecular weight (Mn) of 3.0 to 20.0. The low-temperature fixability, gloss performance, and penetration resistance of the toner become better while the durable stability of the toner is retained.

In order that the above effect may be additionally improved, the Mp is more preferably 7,000 to 25,000, or still more preferably 7,000 to 20,000, and the Mp particularly preferably ranges from 8,000 to 16,000. In addition, the Mw is more preferably 10,000 to 150,000, or still more preferably 10,000 to 120,000, and the Mw particularly preferably ranges from 30,000 to 100,000. Further, the Mw/Mn is more preferably 5.0 to 20.0, or still more preferably 5.0 to 12.0. The Mp, the Mw, and the Mw/Mn described above can be controlled depending on the kind and addition amount of an additive such as the shell resin as well as the binder resin and the wax in each toner particle. When the toner of the present invention is produced by a polymerization method, the above parameters can be controlled depending on, for example, the kind and addition amount of a polymerization initiator, a polymerization temperature, in particular, the temperature at the time of the initiation of the polymerization with reference to the 10-hour half-life temperature of the polymerization initiator, and the kind and addition amount of a crosslinking agent.

It is preferred that the toner of the present invention contain THF insoluble matter obtained by a Soxhlet extraction method, and a content of the THF insoluble matter obtained by the Soxhlet extraction method be 5.0 to 35.0 mass % with respect to the toner. The low-temperature fixability, gloss performance, and penetration resistance of the toner become better while the durable stability of the toner is retained. In order that the above effect may be additionally improved, the content of the THF insoluble matter is more preferably 5.0 to 20.0 mass %, or still more preferably 5.0 to 12.0 mass %, and the content of the THF insoluble matter particularly preferably ranges from 6.0 to 10.0 mass %.

The above content of the THF insoluble matter can be controlled depending on the kind and addition amount of an additive such as the shell resin as well as the binder resin and the wax in each toner particle. When the toner of the present invention is produced by a polymerization method, the content can be controlled depending on, for example, the kind and addition amount of the polymerization initiator, a polymerization temperature, in particular, the temperature at the time of the initiation of the polymerization with reference to the 10-hour half-life temperature of the polymerization initiator, and the kind and addition amount of the crosslinking agent.

When the toner of the present invention is produced by a polymerization method, the addition amount of the crosslinking agent is preferably 0.40 to 3.00 parts by mass with respect to 100 parts by mass of a polymerizable monomer as a raw material for the binder resin of the toner on condition that the above content of the THF insoluble matter falls within the above range. When the addition amount of the crosslinking agent falls within the above range, the content of the THF insoluble matter of the toner is generally apt to be large, and when the content of the THF insoluble matter falls within the above range, the low-temperature fixability and durable stability of the toner become better. A state where the content of the THF insoluble matter of the toner is small in spite of the fact that the addition amount of the crosslinking agent is large may correspond to a state where the binder resin of the toner has a large number of branches in its main chain, but has a small number of crosslinking bonds. When the toner is produced by a polymerization method including the step of polymerizing the polymerizable monomer as a raw material for the binder resin after dissolving the shell resin in the monomer in advance, the amount of the crosslinking agent is large, so the binder resin crosslinks with the shell resin as well, and the content of the THF insoluble matter of the toner is apt to be particularly large. When the content of the THF insoluble matter of the toner is small in spite of the fact that the addition amount of the crosslinking agent is large, an affinity between the core phase and the shell phase additionally improves, and hence the low-temperature fixability and durable stability of the toner become better. Accordingly, the above addition amount of the crosslinking agent is more preferably 0.50 to 2.00 parts by mass, or still more preferably 0.70 to 1.40 parts by mass.

A method of controlling the content of the THF insoluble matter of the toner to a low level in spite of the fact that the addition amount of the crosslinking agent is large as described above is a method in which the content can be controlled depending on, for example, the polymerization temperature with reference to the glass transition point (Tg) of the binder resin in each toner particle, the kind and addition amount of the polymerization initiator, and the kind and addition amount of the crosslinking agent. A method involving setting the polymerization temperature at the time of the initiation of the polymerization so that the temperature may be higher than the 10-hour half-life temperature of the polymerization initiator by 15.0 to 50.0° C. is preferred because a radical concentration at the initial stage of the polymerization can be increased. When the radical concentration at the initial stage of the polymerization is high, many polymer chains having a uniform molecular weight can be produced from an early stage of the polymerizing step. Because the difficulty with which a crosslinking reaction between the polymer chains occurs is raised as the speed at which the polymer chains are formed increases, it is possible that the content of the THF insoluble matter can be controlled to a lower level than those in ordinary cases. In addition, setting the polymerization temperature so that the temperature may be higher than the Tg of the binder resin intensifies the motion of molecular chains of the binder resin during the polymerization to suppress a crosslinking between the molecular chains. It is possible that the content of the THF insoluble matter of the toner is controlled to a low level as a result of the setting. In addition, the content can be controlled depending on the kind and addition amount of an additive such as the shell resin as well.

It is preferred that the toner of the present invention contain THF soluble matter obtained by a Soxhlet extraction method, and the content of a sulfur element originating from sulfonic groups obtained by fluorescent X-ray measurement for the THF soluble matter be 0.005 to 0.300 mass % with respect to the content of the THF soluble matter. It should be noted that the foregoing point is described later.

It is preferred that the toner of the present invention contain 2-propanol (IPA) soluble matter obtained by a Soxhlet extraction method, and the content of the 2-propanol (IPA) soluble matter be 10.0 to 50.0 mass % with respect to the toner. The above IPA soluble matter may be components that improve the thermoplasticity of the toner such as a component having a relatively low molecular weight and a component having a low Tg in the binder resin of the toner, and the wax. In particular, a state where the content of the IPA soluble matter falls within the above range means that, when the toner is produced by a polymerization method, not all the molecular weights and compositions of the molecules of the binder resin or the like are uniform, but the molecular weights and the compositions have some levels of variations in the polymerization process. The above content of the IPA soluble matter is preferably as large as possible for the purpose of improving the low-temperature fixability and gloss performance of the toner, but when the content is excessively large, the durable stability and penetration resistance of the toner may reduce.

It is particularly preferred that the content of the IPA soluble matter fall within the above range in the case where the content of the THF insoluble matter of the toner is 5.0 to 35.0 mass %. Although the THF insoluble matter is advantageous for improving the offset resistance of the toner, a large content of the THF insoluble matter may lead to a reduction in compatibility between the core phase and the shell phase. In this case, the compatibility between the core phase and the shell phase is improved, and the offset resistance of the toner is favorably exerted by the following procedure, in which the content of the THF insoluble matter is kept at a somewhat low level, and a somewhat large amount of IPA insoluble matter is incorporated into the toner. In order that the above effect may be additionally improved, the content of the IPA soluble matter is more preferably 10.0 to 40.0 mass %, or still more preferably 10.0 to 35.0 mass %, and the above content of the IPA soluble matter particularly preferably ranges from 10.0 to 30.0 mass %.

The above content of the IPA soluble matter can be controlled depending on for example, the polymerization temperature with reference to the glass transition point (Tg) of the binder resin in each toner particle, the kind and addition amount of the polymerization initiator, and the kind and addition amount of the crosslinking agent. A method involving setting the polymerization temperature at the time of the initiation of the polymerization so that the temperature may be higher than the 10-hour half-life temperature of the polymerization initiator by 15.0 to 50.0° C. is preferred because the radical concentration at the initial stage of the polymerization can be increased. When the radical concentration at the initial stage of the polymerization is high, many polymer chains having a uniform molecular weight can be produced from an early stage of the polymerizing step. In addition, the polymer chains can be provided with a uniform, relatively short length, so the content of the IPA soluble matter, can be suitably controlled. In addition, setting the polymerization temperature so that the temperature may be higher than the Tg of the binder resin intensifies the motion of molecular chains of the binder resin during the polymerization to suppress a bonding reaction between the molecular chains during their growth. As a result, the content of the IPA soluble matter of the toner can be increased. In addition, the content can be controlled depending on the kind and addition amount of an additive such as the shell resin as well.

The toner of the present invention preferably contains a styrene acrylic resin, the resin having acrylic acid or methacrylic acid as a copolymerization component in addition to a styrene monomer and an acrylic ester monomer or a methacrylic ester monomer, at a content of 3.0 to 90.0 parts by mass with respect to 100 parts by mass of the binder resin. In addition, the styrene acrylic resin preferably has an acid value of 3.0 to 30.0 mgKOH/g. In addition, the toner particles according to the present invention each preferably have a core-shell structure, and the styrene acrylic resin preferably exists as a resin of which a shell phase is formed. When the toner particles are produced by a suspension polymerization method, the molecules of the styrene acrylic resin can be efficiently localized to the vicinity of the surface of the toner by virtue of an action of acrylic acid or methacrylic acid. When the styrene acrylic resin has styrene and acrylic acid or methacrylic acid as copolymerization components, the resin and the binder resin of the toner are partly compatible with each other, so no clear interface between both the resins exists. In addition, when the acid value of the styrene acrylic resin is 3.0 to 30.0 mgKOH/g, a balance between a function of localizing the molecules of the resin to the vicinities of the surfaces of the toner particles and a function of making the resin and the binder resin compatible with each other becomes better. The acid value of the resin is more preferably 5.0 to 20.0 mgKOH/g, or still more preferably 6.0 to 15.0 mgKOH/g. When the content of the styrene acrylic resin falls within the above range, the content of the styrene acrylic resin in each toner particle becomes moderate. The content of the resin is more preferably 5.0 to 30.0 parts by mass, or still more preferably 10.0 to 25.0 parts by mass.

In addition to the foregoing, the styrene acrylic resin preferably contains tetrahydrofuran (THF) soluble matter at a content of 85.0 mass % or more and methanol insoluble matter at a content of 90.0 mass % or more. In this case, uniformity in the contents of the styrene acrylic resin in the toner particles is improved, and uniformity in the states of presence where the styrene acrylic resin is localized in the toner particles is improved.

When the content of the THF soluble matter in the styrene acrylic resin falls within the above range, the uniformity in the contents of the styrene acrylic resin in the toner particles is additionally improved. In addition, when the toner is produced by a method involving forming the particles in water, the particle diameter distribution of the toner can be additionally sharpened. The content of the THF soluble matter in the styrene acrylic resin is more preferably 90.0 mass % or more, or particularly preferably 96.0 mass % or more.

Similarly, when the acid value of the styrene acrylic resin is 3.0 to 30.0 mgKOH/g, a component that dissolves in methanol is apt to be produced as a by-product. Suppressing the production of the component that dissolves in methanol additionally improves the uniformity in the contents of the styrene acrylic resin in the toner particles. Further, the suppression improves the uniformity in the states of presence where the styrene acrylic resin is localized in the toner particles. Accordingly, the content of the methanol insoluble matter in the styrene acrylic resin is more preferably 95.0 mass % or more, or still more preferably 96.0 to 99.5 mass %.

The styrene acrylic resin preferably has a weight-average molecular weight (Mw) in terms of styrene (PSt) obtained by gel permeation chromatography (GPC) of 2,500 to 150,000 and a ratio (Mw/Mn) between the weight-average molecular weight (Mw) and a number-average molecular weight (Mn) of 1.10 to 10.00. When the Mw of the styrene acrylic resin falls within the above range, the compatibility of the resin for the binder resin becomes additionally moderate, so the uniformity in each of the states of presence and contents of the resin in the toner particles is additionally improved. The Mw of the styrene acrylic resin is more preferably 3,000 to 120,000, or still more preferably 3,000 to 60,000, and the Mw of the styrene acrylic resin particularly preferably ranges from 6,000 to 60,000. Meanwhile, when the Mw/Mn of the styrene acrylic resin falls within the above range, the uniformity in the contents of the resin in the toner particles is improved, and the durable stability of the toner can be made better. The Mw/Mn of the resin is more preferably 1.50 to 5.00, or still more preferably 2.00 to 4.00.

The styrene acrylic resin preferably has a ratio (Mp/Mw) between a peak molecular weight [most frequent molecular weight] (Mp) and the Mw in its molecular weight distribution in terms of styrene obtained by the above GPC of 0.50 to 3.00. A state where the Mp/Mw is small means that the content of a component having a particularly large molecular weight is small with respect to a component having such a molecular weight as to be a main component, and the state is preferred in terms of the improvement of the uniformity in the contents of the resin in the toner particles. In this case, the durable stability of the toner becomes good. The Mp/Mw of the resin is more preferably 0.80 to 2.00, or still more preferably 0.90 to 1.50, and the Mp/Mw of the resin particularly preferably ranges from 1.01 to 1.30.

The styrene acrylic resin preferably has a glass transition point (Tg) measured with a differential scanning calorimeter (DSC) of 55.0 to 95.0° C. When the Tg of the resin falls within the above range, compatibility between the low-temperature fixability and blocking resistance of the toner is achieved, and further, the penetration resistance, durable stability, and image-storing performance of the toner become better. The Tg of the resin measured with the DSC is more preferably 60.0 to 95.0° C., or still more preferably 65.0 to 95.0° C.

In the present invention, a resin produced by any one of the following methods can be used as the above styrene acrylic resin:

(1) a solid-phase polymerization method involving polymerizing a monomer in a state where substantially no solvent is present;

(2) a solution polymerization method involving adding all monomers, all polymerization initiators, and a solvent to be used for polymerization and collectively polymerizing the mixture; and (3) a dropping polymerization method involving polymerizing a monomer while adding the monomer during the polymerization reaction. In addition, a resin produced by a normal-pressure polymerization method or a high-pressure polymerization method can be used.

In the present invention, the above styrene acrylic resin is preferably produced by (3) the dropping polymerization method. A difference in rate of polymerization between an acid monomer such as acrylic acid or methacrylic acid and styrene as copolymerization components is suppressed, and the content of each of the THF soluble matter and the methanol insoluble matter is easily suppressed. In addition, the above polymerization is preferably performed by the high-pressure polymerization method. The reaction progresses in an additionally uniform fashion, so the content of each of the THF soluble matter and the methanol insoluble matter is easily suppressed.

In the present invention, the resin is preferably produced, out of the dropping polymerization methods, by a multistage dropping polymerization method, involving making small the ratio at which an acrylic monomer having a smaller monomer Q value than that of styrene is blended as compared to a target copolymerization ratio between styrene and the acrylic monomer at the initial stage of polymerization, and increasing the ratio at which the acrylic monomer is blended as the polymerization progresses. The contents of acrylic acid or methacrylic acid in the respective molecular chains of the styrene acrylic resin can be additionally uniformized, and the Mw/Mn of the resin can be held at a small value.

The above Q value is a value inherent in a monomer, and represents reactivity in the copolymerization. For example, there may be used values described in "POLYMER HANDBOOK Third Edition" (A WILEY-INTERSCIENCE PUBLICATION JOHN WILEY & SONS) (II/page 268). Specific examples of the Q-value of a monomer include styrene: 1.00, butyl acrylate: 0.38, methyl acrylate: 0.45, methyl methacrylate: 0.78, acrylic acid: 0.83, methacrylic acid: 0.98, and 2-hydroxyethyl methacrylate: 1.78.

It is preferred that the toner of the present invention have a weight-average particle diameter (D4) of 3.0 to 8.0 μm and a ratio (D4/D1) between the D4 and a number-average particle diameter D1 of 1.00 to 1.30. The durable stability of the toner becomes better. When the (D4/D1) falls within the above range, the contents and states of presence of the shell phase in the toner become additionally uniform. It should be noted that the (D4/D1) is an index representing the extent to which particle diameters are distributed, and the ratio is 1.00 when the toner particles are completely monodisperse. The larger the extent to which the value exceeds 1.00, the larger the particle diameter distribution. The D4 is more preferably 3.0 to 7.0 μm, or still more preferably 4.0 to 6.0 μm. In addition, the (D4/D1) is more preferably 1.00 to 1.25, still more preferably 1.00 to 1.20, or particularly preferably 1.00 to 1.15.

The toner of the present invention preferably has an average circularity of the toner of 0.960 to 1.000, the average circularity being obtained by dividing circularities measured with a flow-type particle image measuring device having an image processing resolution of 512×512 pixels (0.37 μm by 0.37 μm per pixel) into 800 sections in a circularity range of 0.200 to 1.000 and by analyzing the circularities. When the average circularity is 0.960 to 1.000, the contents and states of presence of the shell phase in the toner become additionally uniform. The average circularity is more preferably 0.970 to 1.000, or still more preferably 0.980 to 1.000. An apparatus that can be used in the above circularity measurement is, for example, a flow-type particle image analyzer "FPIA-3000" (manufactured by SYSMEX CORPORATION).

The measurement principle of a flow-type particle image analyzer "FPIA-3000" (manufactured by SYSMEX CORPORATION) includes flowing particles being photographed as a static image, and the image being analyzed. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 pixels (0.37 μm by 0.37 μm per pixel), whereby the border of each particle image is sampled. Then, the projected area S, perimeter L, and the like of each particle image are measured.

Next, a circle-equivalent diameter and a circularity are determined using the area S and perimeter L. The circle-equivalent diameter is defined as the diameter of a circle having the same area as that of the projected area of a particle image, the circularity C is defined as a value obtained by dividing the perimeter of a circle determined from the circle-equivalent diameter by the perimeter of a particle projected image, and the circularity is calculated from the following equation.

$$\text{Circularity } C = 2\times(\pi S)^{1/2}/L$$

When a particle image is of a complete round shape, the circularity of the particle in the image becomes 1.000. The larger the degree of irregularity of the periphery of a particle image, the smaller the value of circularity of the particle in the image. After the circularities of the respective particles have been calculated, average circularity values are obtained by dividing a circularity range of 0.200 to 1.000 into 800 sections and by calculating the arithmetic mean value of the obtained circularity.

The toner of the present invention preferably has a standard deviation SD of the circularities obtained by the above method of 0.050 or less. When the SD exceeds 0.050, the contents and states of presence of the shell phase in the toner may become non-uniform, and the durable stability of the toner may reduce. Accordingly, the SD is more preferably 0.030 or less, or still more preferably 0.020 or less.

The D4, D4/D1, average circularity, and SD of the toner described above can be controlled depending on the physical properties of the styrene acrylic resin of the toner such as the molecular weight, acid value, and contents of the THF soluble matter and the methanol insoluble matter of the resin, and conditions under which the toner particles are produced such as the addition amount of the resin, and a temperature and the addition amount of a dispersion stabilizer at the time of the production.

Next, materials that can be used in the toner of the present invention, and methods of producing the materials are described.

A styrene acrylic resin is preferably used as the binder resin for use in the toner of the present invention. Vinyl-based monomers for producing the styrene acrylic resin and a styrene acrylic resin to be used as the shell phase are, for example, the following compounds.

Styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate derivatives or methacrylate derivatives such as acrylonitrile, methacrylonitrile, and acrylamide.

Examples further include the following compounds: unsaturated dibasic acids such as maleic acid, citraconic acid, itaconic acid, an alkenylsuccinic acid, fumaric acid, and mesaconic acid; unsaturated dibasic anhydrides such as maleic anhydride, citraconic anhydride, itaconic anhydride, and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and anhydrides and monoesters of those acids.

Examples further include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl) styrene and 4-(1-hydroxy-1-methylhexyl)styrene.

The styrene-acrylic resin to be used as the binder resin for the toner of the present invention may have a crosslinking structure cross linked with a crosslinking agent having two or more vinyl groups. In this case, examples of the crosslinking agent to be used include aromatic divinyl compounds such as divinylbenzene and divinylnaphthalene. Examples of diacrylate compounds bonded together with an alkyl chain include the following compounds: ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylate of each of the above-mentioned compounds to methacrylate. Examples of diacrylate compounds bonded together with an alkyl chain containing an ether bond include the following compounds: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylate of each of the above-mentioned compounds to methacrylate. Examples of diacrylate compounds bonded together with a chain containing an aromatic group and an ether bond include polyoxyethylene (2)-2,2-bis(4-hydroxyphenyl) propane diacrylate, polyoxyethylene (4)-2,2-bis(4-hydroxyphenyl) propane diacrylate, and those obtained by changing the acrylate of each of the above-mentioned compounds to methacrylate.

Examples of the polyfunctional crosslinking agents include the following compounds: pentaerythritol triacrylate, trimethylolethane triacrylate, trimethylolpropane triacrylate, tetramethylolmethane tetraacrylate, oligoester acrylate, and those obtained by changing the acrylate of the above-mentioned compounds to methacrylate; and triallyl cyanurate and triallyl trimellitate.

Examples of the polymerization initiators to be used when producing a styrene-acrylic resin to be included as a binder resin or a styrene-acrylic resin to be used as a shell resin in the toner of the present invention include the following compounds.

As an azo-based polymerization initiator, the following compounds are exemplified: 2,2'-azobisisobutyronitrile,
2,2'-azobis (4-methoxy-2,4-dimethylvaleronitrile),
2,2'-azobis(2,4-dimethylvaleronitrile),
2,2'-azobis(2-methylbutyronitrile),
dimethyl-2,2'-azobisisobutyrate,
1,1'-azobis(1-cyclohexanecarbonitrile),
2-(carbamoylazo)-isobutyronitrile,
2,2'-azobis(2,4,4-trimethylpentane),
2-phenylazo-2,4-dimethyl-4-methoxyvaleronitrile, and
2,2'-azobis(2-methyl-propane).

As a peroxide-based polymerization initiator the following compounds are exemplified: peroxyketals such as 2,2-bis (4,4-di-t-butylperoxycyclohexyl) propane (molecular weight: 561, theoretical active oxygen content: 11.4%, and 10-hour half-life temperature: 94.7° C.), 1 μl-di(t-hexylperoxy)cyclohexane (molecular weight: 316, theoretical active oxygen content: 10.1%, and 10-hour half-life temperature: 87.1° C.), 1,1-di(t-butylperoxy)cyclohexane (molecular weight: 260, theoretical active oxygen content: 12.3%, and 10-hour half-life temperature: 90.7° C.), n-butyl-4,4-di(t-butylperoxy)valerate (molecular weight: 334, theoretical active oxygen content: 9.6%, and 10-hour half-life temperature: 104.5° C.), 2,2-di(t-butylperoxy)butane (molecular weight: 234, theoretical active oxygen content: 13.7%, and 10-hour half-life temperature: 103.1° C.), and 1,1-di (t-butylperoxy)-2-methylcyclohexane (molecular weight: 274, theoretical active oxygen content: 11.7%, and 10-hour half-life temperature: 83.2° C.); hydroperoxides such as t-butyl hydroperoxide (molecular weight: 90, theoretical active oxygen content: 17.8%, and 10-hour half-life temperature: 166.5° C.), cumen hydroperoxide (molecular weight: 152, theoretical active oxygen content: 10.5%, and 10-hour half-life temperature: 157.9° C.), diisopropylbenzene hydroperoxide (molecular weight: 194, theoretical active oxygen content: 8.2%, and 10-hour half-life temperature: 145.1° C.), p-menthane hydroperoxide (molecular weight: 172, theoretical active oxygen content: 9.3%, and 10-hour half-life temperature: 128.0° C.), and 1,1,3,3-tetramethylbutyl hydroperoxide (molecular weight: 146, theoretical active oxygen content: 10.9%, and 10-hour half-life temperature: 152.9° C.); dialkyl peroxides such as t-butylcumyl peroxide (molecular weight: 208, theoretical active oxygen content: 7.7%, and 10-hour half-life temperature: 119.5° C.), di-t-butyl peroxide (molecular weight: 146, theoretical active oxygen content: 10.9%, and 10-hour half-life temperature: 123.7° C.), and di-t-hexyl peroxide (molecular weight: 202, theoretical active oxygen content: 7.9%, and 10-hour half-life temperature: 116.4° C.); diacyl peroxides such as diisobutyl peroxide (molecular weight: 174, theoretical active oxygen content: 9.2%, and 10-hour half-life temperature: 32.7° C.), di (3,5,5-trimethylhexanoyl) peroxide (molecular weight: 314, theoretical active oxygen content: 5.1%, and 10-hour half-life temperature: 59.4° C.), dilauroyl peroxide (molecular weight: 399, theoretical active oxygen content: 4.0%, and 10-hour half-life temperature: 61.6° C.), disuccinic acid peroxide (molecular weight: 234, theoretical active oxygen content: 6.8%, and 10-hour half-life temperature: 65.9° C.), benzoyl peroxide (molecular weight: 242, theoretical active oxygen content: 6.6%, and 10-hour half-life temperature: 73.6° C.), and benzoyl m-methylbenzoyl peroxide or m-toluoyl peroxide (10-hour half-life temperature: 73.1° C.); peroxydicarbonates such as diisopropyl peroxydicarbonate (molecular weight: 206, theoretical active oxygen content: 7.8%, and 10-hour half-life temperature: 40.5° C.), di-n-propyl peroxydicarbonate (molecular weight: 206, theoretical active oxygen content: 7.8%, and 10-hour half-life temperature: 40.3° C.), bis (4-t-butylcyclohexyl)peroxydicarbonate (molecular weight: 399, theoretical active oxygen content: 4.0%, and 10-hour half-life temperature: 40.8° C.), di-2-ethylhexyl peroxydicarbonate (molecular weight: 346, theoretical active oxygen content: 4.6%, and 10-hour half-life temperature: 43.6° C.), and di-sec-butyl peroxydicarbonate (molecular weight: 234, theoretical active oxygen content: 6.8%, and 10-hour half-life temperature: 40.5° C.); and peroxyesters such as cumyl peroxyneodecanoate (molecular weight: 306, theoretical active oxygen content: 5.2%, and 10-hour half-life temperature: 36.5° C.), 1,1,3,3-tetramethylbutyl peroxyneodecanoate (molecular weight: 300, theoretical active oxygen content: 5.3%, and 10-hour half-life temperature 40.7° C.), t-hexyl peroxydecanoate (molecular weight: 272, theoretical active oxygen content: 5.9%, and 10-hour half-life temperature: 44.5° C.), t-butyl peroxyneodecanoate (molecular weight: 244, theoretical active oxygen content: 6.6%, and 10-hour half-life temperature: 46.4° C.), t-butyl peroxyneoheptanoate (molecular weight: 202, theoretical active oxygen content: 7.9%, and 10-hour half-life temperature: 50.6° C.), t-hexyl peroxypivalate (molecular weight: 202, theoretical active oxygen content: 7.9%, and 10-hour half-life temperature: 53.2° C.), t-butylperoxypivalate (molecular weight 174, theoretical active oxygen content: 9.2%, and 10-hour half-life temperature: 54.6° C.), 2,5-dimethyl-2,5-di(2-ethylhexanoylperoxy)hexane (molecular weight: 431, theoretical active oxygen content: 7.4%, and 10-hour half-life temperature: 66.2° C.), 1,1,3,3-tetramethylbutylperoxy-2-ethylhexanoate (molecular weight: 272, theoretical active oxygen content: 5.9%, and 10-hour half-life temperature: 65.3° C.), t-hexylperoxy-2-ethylhexanoate (molecular weight: 244, theoretical active oxygen content: 6.6%, and 10-hour half-life temperature: 69.9° C.), t-butylperoxy-2-ethylhexanoate (molecular weight: 216, theoretical active oxygen content: 7.4%, and 10-hour half-life temperature: 72.1° C.), t-butylperoxylaurate (molecular weight: 272, theoretical active oxygen content: 5.9%, and 10-hour half-life temperature: 98.3° C.), t-butylperoxy-3,5,5-trimethylhexanoate (molecular weight: 230, theoretical active oxygen content: 7.0%, and 10-hour half-life temperature: 97.1° C.), t-hexylperoxyisopropyl monocarbonate (molecular weight: 204, theoretical active oxygen content: 7.8%, and 10-hour half-life temperature: 95.0° C.), t-butylperoxyisopropyl monocarbonate (molecular weight: 176, theoretical active oxygen content: 9.1%, and 10-hour half-life temperature: 98.7° C.), t-butylperoxy-2-ethylhexyl monocarbonate (molecular weight: 246, theoretical active oxygen content: 6.5%, and 10-hour half-life temperature: 99.0° C.), 2,5-dimethyl-2,5-di(benzoylperoxy)hexane (molecular weight: 386, theoretical active oxygen content: 8.3%, and 10-hour half-life temperature: 99.7° C.), t-butylperoxyacetate (molecular weight: 132, theoretical active oxygen content: 12.1%, and 10-hour half-life temperature: 101.9° C.), t-hexyl peroxybenzoate (molecular weight: 222, theoretical active oxygen content: 7.2%, and 10-hour half-life temperature: 99.4° C.), t-butylperoxy-3-methylbenzoate (theoretical active oxygen content: 8.1%), and t-butyl peroxybenzoate (molecular weight: 194, theoretical active oxygen content: 8.2%, and 10-hour half-life temperature: 104.3° C.)

When the toner of the present invention has a styrene acrylic resin as the binder resin, a polymerization initiator to be used in polymerization for the styrene acrylic resin is preferably a peroxide-based polymerization initiator. Because the reaction tends to progress smoothly with the peroxide-based polymerization initiator as compared to an azo-based polymerization initiator, the contents of the THF insoluble matter, and the contents of the IPA soluble matter, in the toner particles easily become uniform. Accordingly, the durable stability of the toner is easily held at a good level even when one aims to achieve an additional improvement in low-temperature fixability of the toner. The peroxide-based polymerization initiator is particularly preferred when the polymerizable monomer for the binder resin is polymerized in the presence of a resin component such as the shell resin. The peroxide-based initiator easily causes a hydrogen abstraction reaction for the resin component such as the shell resin, so a branched resin in which the resin component and part of the binder resin are graft-bonded can be produced. As a result, the contents of the shell resin in the toner particles easily become uniform, and the states of presence of the shell resin easily become uniform even when the particles are turned into toner.

Of the peroxide-based polymerization initiators, peroxy esters, peroxy ketals, and diacyl peroxides are preferred from the viewpoint of compatibility between the low-temperature fixability and durable stability of the toner. From the viewpoint of the low-temperature fixability of the toner, the peroxy esters are particularly preferred peroxide-based polymerization initiators.

The peroxide-based polymerization initiator for use in the toner of the present invention is preferably a peroxide-based polymerization initiator having a 10-hour half-life temperature of 30.0 to 130.0° C. A polymerization initiator having a low 10-hour half-life temperature is preferably used because a radical concentration at the initial stage of the polymerization can be increased. When the radical concentration at the initial stage of the polymerization is high, many molecular chains having a uniform molecular weight can be produced from an early stage of the polymerizing step. In addition, setting the polymerization temperature so that the temperature may be higher than the Tg of the binder resin intensifies the motion of the molecular chains during the polymerization to suppress a bonding reaction or crosslinking between the molecular chains during their growth. As a result, the content of the THF insoluble matter of the toner can be reduced, and the content of the IPA soluble matter of the toner can be favorably controlled. Accordingly, the above 10-hour half-life temperature of the peroxide-based polymerization initiator is more preferably 30.0 to 100.0° C., or still more preferably 40.0 to 90.0° C., and the above 10-hour half-life temperature particularly preferably ranges from 40.0 to 70.0° C.

The peroxide-based polymerization initiator for use in the toner of the present invention is preferably a peroxide-based polymerization initiator having a branched alkyl group such as a t-butyl group, a t-hexyl group, or a 1,1,3,3-tetramethylbutyl group. The branched alkyl group can be introduced into a terminal of each molecular chain of the binder resin of the toner, so the number of branches of the molecular chains can be efficiently increased. In addition, the introduction of bulky branched alkyl groups into the molecular chains suppresses a bonding reaction or crosslinking between the molecular chains during their growth. As a result, the content of the THF insoluble matter of the toner can be reduced, and the content of the IPA soluble matter of the toner can be favorably controlled. From the viewpoint of the low-temperature fixability of the toner, a peroxide-based polymerization initiator having a t-butyl group and a t-hexyl group as branched alkyl groups is preferred, and a peroxide-based polymerization initiator having a t-butyl group is a particularly preferred peroxide-based polymerization initiator. Further, the peroxide-based polymerization initiator for use in the toner of the present invention is preferably a peroxide-based polymerization initiator having the above branched alkyl group on each of both sides between which a peroxy group or peroxy ester group is sandwiched by the same reason as that described above.

The peroxide-based polymerization initiator for use in the toner of the present invention is preferably a peroxide-based polymerization initiator having a molecular weight of 140 to 400 and a theoretical active oxygen content of 5.00 to 12.00%. The number of carbon atoms of a functional group introduced into a terminal of each molecular chain of the binder resin, and a balance between the polymerization reaction and the hydrogen abstraction reaction become better, so the low-temperature fixability and durable stability of the toner tend to be better. Accordingly, the molecular weight of the peroxide-based polymerization initiator is more preferably 140 to 350, or still more preferably 150 to 300, and the molecular weight of the peroxide-based polymerization initiator particularly preferably ranges from 160 to 250. In addition, the theoretical active oxygen content of the peroxide-based polymerization initiator is more preferably 6.00 to 11.00%, or still more preferably 6.80 to 11.00%.

The toner of the present invention includes one kind or two or more kinds of waxes. Examples of the wax which can be used in the present invention include the following compounds: aliphatic hydrocarbon waxes such as a low molecular weight polyethylene, a low molecular weight polypropylene, an alkylene copolymer, a microcrystalline wax, a paraffin wax, and a Fischer-Tropsch wax; an aliphatic hydrocarbon-based wax oxide such as a polyethylene oxide wax or block copolymers of aliphatic hydrocarbon waxes; a wax containing a fatty acid ester as a main component such as a carnauba wax, behenic acid behenyl ester wax, and a montanate wax; and a wax containing a fatty acid ester deoxidated partially or totally such as a deoxidated carnauba wax. Further, examples of the wax include: linear saturated fatty acids such as palmitic acid, stearic acid, and montanoic acid; unsaturated fatty acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; polyalcohols such as sorbitol; esters of fatty acids such as palmitic acid, stearic acid, behenic acid, and montanoic acid and alcohols such as stearyl alcohol, aralkyl alcohol, behenyl alcohol, carnaubyl alcohol, ceryl alcohol, and melissyl alcohol; fatty acid amides such as linoleic amide, oleic amide, and lauric amide; saturated fatty acid bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N'-dioleyl sebacamide; aromatic bis amides such as m-xylene bis stearamide and N—N'-distearyl isophthalamide; aliphatic metal salts (generally called metallic soaps) such as calcium stearate, calcium laurate, zinc stearate, and magnesium stearate; waxes in which aliphatic hydrocarbon-based waxes are grafted with vinyl-based monomers such as styrene and acrylic acid; partially esterified compounds of fatty acids and polyalcohols such as behenic monoglyceride; and methyl ester compounds having a hydroxyl group obtained by hydrogenation of a vegetable oil.

Examples of the wax which are preferably used in the present invention include an aliphatic hydrocarbon-based wax, and an esterified wax as an ester of an aliphatic acid and an alcohol. Desirable examples of the foregoing include: a low molecular weight alkylene polymer obtained by subjecting an alkylene to radical polymerization under high pressure or by polymerizing an alkylene under reduced pressure by using a Ziegler catalyst or a metallocene catalyst; an alkylene polymer obtained by the thermal decomposition of a high molecular weight alkylene polymer; and a synthetic hydrocarbon wax obtained from a residue on distillation of a hydrocarbon obtained by an Age method from a synthetic gas containing carbon monoxide and hydrogen, and a synthetic hydrocarbon wax obtained by the hydrogenation thereof. Further, a product obtained by fractionating such hydrocarbon wax by employing a press sweating method, a solvent method, a utilization of vacuum distillation, or a fractional crystallization mode is more preferably used. A hydrocarbon synthesized by a reaction between carbon monoxide and hydrogen using a metal oxide-based catalyst (a multiple system formed of two or more kinds of elements in many cases) [such as a hydrocarbon compound synthesized by a synthol method or a hydrocol method (involving the use of a fluid catalyst bed)], a hydrocarbon having up to several hundreds of carbon atoms obtained by an Age method (involving the use of an identification catalyst bed) with which a large amount of a wax-like hydrocarbon can be obtained, or a hydrocarbon obtained by polymerizing an alkylene such as ethylene by using a Ziegler catalyst is preferably used as a hydrocarbon as the parent body of such aliphatic hydrocarbon wax because each of the hydrocarbons is a saturated, long, linear hydrocarbon with a small number of small branches. A wax synthesized by a method not involving the polymerization of an alkylene is particularly preferred because of its molecular weight distribution.

The above wax is preferably a wax having a melting point of 55 to 140° C., more preferably a wax having a melting point of 55 to 120° C., or still more preferably a low-melting wax having a melting point of 55 to 100° C. The low-melting wax quickly dissolves at the time of fixation, effectively acts between a fixing roller and a toner interface, and shows a high effect on hot offset.

Of the low-melting waxes, an aliphatic hydrocarbon-based wax or ester wax having a melting point of 55 to 100° C. or lower can achieve compatibility between the low-temperature fixability and durable stability of the toner, and improve the color-developing performance of the colorant of the toner after the fixation. This is probably because of the following reason, in which because the polarity of the aliphatic hydrocarbon-based wax is close to that of the aromatic ring of the pigment as the colorant and the polarity of the ester bond of the ester wax is close to that of the carbonyl group of the pigment, any such wax effectively interacts with the colorant to improve the color-developing performance of the colorant.

A wax to be particularly preferably used is an aliphatic hydrocarbon wax having a short molecular chain and small steric hindrance, and excellent in mobility such as a paraffin wax, polyethylene, or a Fischer-Tropsch wax.

The molecular weight distribution of the wax preferably has a main peak in a molecular weight region of 350 to 2,400, or more preferably has the peak in a molecular weight region of 400 to 2,000 in terms of an improvement in low-temperature fixability of the toner. Providing such molecular weight distribution can impart preferred thermal characteristics to the toner.

The content of the above wax is preferably 3 to 30 parts by mass with respect to 100 parts by mass of the binder resin in terms of compatibility among the low-temperature fixability, offset resistance, and durable stability of the toner. The content of the wax in the toner of the present invention is more preferably 5 to 20 parts by mass, or particularly preferably 6 to 14 parts by mass.

When the wax is extracted from the toner upon determination of such physical properties as described above, a method for the extraction is not particularly limited, and an arbitrary method is available. For example, a predetermined amount of the toner is subjected to Soxhlet extraction with toluene, and the solvent is removed from the resultant toluene soluble matter. After that, chloroform insoluble matter is obtained. Then, the insoluble matter is subjected to identification analysis by an IR method or the like. In addition, with regard to the determination, the insoluble matter is subjected to quantitative analysis with a DSC.

It is preferred that the toner of the present invention have the highest endothermic peak measured with a differential scanning calorimeter (DSC) at 60.0 to 95.0° C. and the endotherm of the endothermic peak be 3.0 to 30.0 J/g. The endothermic peak may be a peak resulting from the melting of waxes in the toner in crystalline states out of the waxes of the toner. The above endotherm preferably falls within the above range in terms of compatibility among the low-temperature fixability, offset resistance, and durable stability of the toner. It is preferred that part of the waxes in the toner of the present invention be caused to be compatible with the binder resin at the time of the production of the toner, another part of the waxes be used as a plasticizer for the binder resin, and still another part of the waxes be used as a release agent for the toner. Further, it is preferred that part of the waxes in the toner in crystalline states be further caused to be compatible with the binder resin in a fixing step so as to be used as a plasticizer. Accordingly, larger amounts of waxes than those in ordinary cases are preferably incorporated because not all the waxes of the toner act as release agents. The above endotherm of the endothermic peak is more preferably 5.0 to 20.0 J/g, or still more preferably 6.0 to 15.0 J/g.

The toner of the present invention may use a charge control agent.

Charge control agents for controlling the toner particles so that the particles may be negatively chargeable are, for example, the following substances.

Examples thereof include an organo-metallic compound, a chelate compound, a monoazo metal compound, an acetylacetone metal compound, a urea derivative, a metal-containing salicylic acid-based compound, a metal-containing naphthoic acid-based compound, a quaternary ammonium salt, calixarene, a silicon compound, a non-metal carboxylic acid-based compound, and derivatives thereof. In addition, a sulfonic acid resin having a sulfonic acid group, a sulfonic acid base, or a sulfonic ester group may be preferably used.

Examples of the charge control agent for controlling a toner particle to positive charge include the following charge control agents: nigrosine and modified products modified by fatty acid metal salts; quaternary ammonium salts such as tributylbenzylammonium-1-hydroxy-4-naphthosulfonic acid salts and tetrabutylammonium tetrafluoroborate, onium salts such as a phosphonium salt which are analogs thereof, and a lake pigment thereof; a triphenylmethane dye and a lake pigment thereof (as a laking agent, there are exemplified phosphorus tungstate, phosphorus molybdate, phosphorus tungstemolybdate, tannin acid, lauric acid, gallic acid, ferricyanide, and ferrocyanide); and metal salts of higher fatty acids. Those charge control agents may be used alone, or two or more kinds may be used in combination.

The above charge control agent is incorporated at a content of preferably 0.01 to 20 parts by mass, or more preferably 0.1 to 10 parts by mass with respect to 100 parts by mass of the binder resin in the toner particles in terms of the low-temperature fixability of the toner.

The toner of the present invention preferably contains a resin containing a sulfonic acid-based functional group having a sulfonic group, a sulfonate group, or a sulfonic acid ester group (hereinafter, referred to as "sulfonic acid-based resin"). A styrene acrylic resin, polyester, polyurethane, polyurea, polyamide, or the like can be used as a resin to serve as a main component for the above sulfonic acid-based resin. In the case of a toner having a styrene acrylic resin as the binder resin, the main component for the above sulfonic acid-based resin is preferably a styrene acrylic resin. Particularly in the case of a toner having a core-shell structure, the incorporation of such sulfonic acid-based resin as described above raises the ease with which the molecules of the sulfonic acid-based resin are localized to the vicinities of the surfaces of the toner particles, so the durable stability of the toner easily improves. Further, in the case of a toner having a shell resin having an acid value, part of the polar groups of the shell resin and a sulfonic group of the sulfonic acid-based resin interact with each other to additionally raise the ease with which the durable stability of the toner improves. The contents of the above sulfonic acid-based resin in the toner particles easily become uniform, and the durable stability of the toner easily becomes better particularly when the main component for the sulfonic acid-based resin is a styrene acrylic resin. On the other hand, when the content of the sulfonic acid-based resin is excessively large, or when the content of the sulfonic groups of the sulfonic acid-based resin is excessively large, the low-temperature fixability of the toner may reduce.

Accordingly, the toner of the present invention preferably contains a sulfur element originating from sulfonic groups obtained by fluorescent X-ray measurement for the THF soluble matter obtained by a Soxhlet extraction method at a content of 0.005 to 0.300 mass % with respect to the content of the THF soluble matter. When the content of the sulfur element is less than 0.005 mass %, the durable stability and penetration resistance of the toner may reduce. When the content of the sulfur element exceeds 0.300 mass %, the low-temperature fixability and gloss performance of the toner may reduce. Accordingly, the content of the sulfur element is more preferably 0.020 to 0.300 mass %, or still more preferably 0.040 to 0.200 mass %.

The above content of the sulfur element can be controlled depending on the content of the sulfonic groups of the sulfonic acid-based resin and the addition amount of the sulfonic acid-based resin.

A functional group particularly preferably used as a sulfonic group, sulfonate group, or sulfonic acid ester group of the above sulfonic acid-based resin is, for example, any one of the functional groups represented by the following formulae (1) to (6). It is preferred that the functional group be directly bonded to the main chain of the styrene acrylic resin.

[Chem 1]

formulae (1)

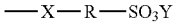

[Chem 2]

formulae (2)

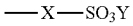

[Chem 3]

formulae (3)

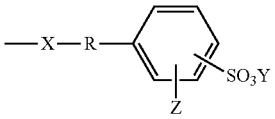

[Chem 4]

formulae (4)

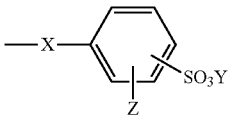

[Chem 5]

formulae (5)

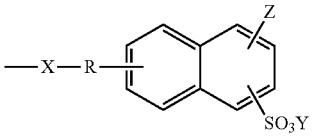

[Chem 6]

formulae (6)

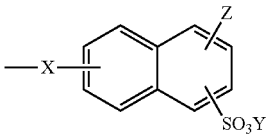

[In the above formulae (1) to (6), X represents an amide bond, R represents a linear or branched alkanediyl group having 1 to 8 carbon atoms, Y represents hydrogen, an alkali metal, or a linear or branched alkyl group having 1 to 6 carbon atoms, and Z represents hydrogen, or a linear or branched alkyl group having 1 to 6 carbon atoms.]

Of the compounds having functional groups each represented by the above formula (4), a sulfonic acid-based resin having a repeating unit represented by the following formula (7) is preferred from the viewpoints of the low-temperature fixability and durable stability of the toner.

[Chem 7]

formulae (7)

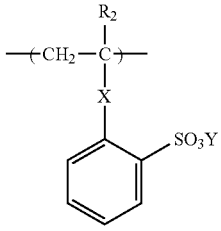

[In the above formula (7), X represents an amide bond, Y represents hydrogen, an alkali metal, or a linear or branched alkyl group having 1 to 6 carbon atoms, and $R_2$ represents hydrogen, or a methyl group.]

Of the compounds having functional groups each represented by the above formula (6), a sulfonic acid-based resin having a repeating unit represented by the following formula (8) is preferred from the viewpoints of the low-temperature fixability and durable stability of the toner.

[Chem 8]

formulae (8)

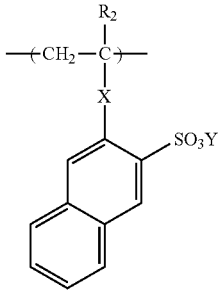

[In the above formula (8), X represents an amide bond, Y represents hydrogen, an alkali metal, or a linear or branched alkyl group having 1 to 6 carbon atoms, and $R_2$ represents hydrogen, or a methyl group]

Of the compounds having functional groups each represented by the above formula (1), a sulfonic acid-based resin having a repeating unit represented by the following formula (9) is preferred from the viewpoints of the low-temperature fixability and durable stability of the toner.

[Chem 9]

formulae (9)

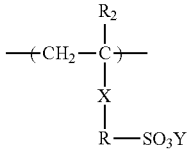

[In the above formula (9), X represents an amide bond, R represents a linear or branched alkanediyl group having 1 to 8 carbon atoms, Y represents hydrogen, an alkali metal, or a linear or branched alkyl group having 1 to 6 carbon atoms, and $R_2$ represents hydrogen, or a methyl group.]

The above sulfonic acid-based resin preferably has a glass transition temperature (Tg) of 30.0 to 100.0° C. The low-temperature fixability and durable stability of the toner are each exerted in an additionally favorable fashion. In addition, in the case of a toner having a core-shell structure, when the molecules of the sulfonic acid-based resin having an excessively high Tg are localized in large amounts to the vicinities of the surfaces of the particles of the toner, differences in thermodynamic characteristics between the vicinities of the surfaces and the vicinities of the centers of the toner particles become excessively large, so the durable stability of the toner may reduce. Accordingly, the Tg of the above sulfonic acid-based resin is more preferably 35.0 to 80.0° C., or still more preferably 40.0 to 75.0° C.

The content of the sulfonic groups, sulfonate groups, or sulfonic acid ester groups of the above sulfonic acid-based resin is preferably 0.01 to 20.00 mass % with respect to the mass of the sulfonic acid-based resin. When the content of the sulfonic groups, sulfonate groups, or sulfonic acid ester groups falls within the above range, the contents of the sulfonic acid-based resin in the toner particles tend to be additionally uniform. Accordingly, the durable stability of the toner becomes better even when one aims to improve the low-temperature fixability of the toner. The content is more preferably 0.01 to 10.00 mass %, or still more preferably 0.02 to 5.00 mass %.

The above sulfonic acid-based resin preferably has an acid value of 1.0 to 80.0 mgKOH/g from the viewpoint of compatibility between the low-temperature fixability and durable stability of the toner. The acid value of the sulfonic acid-based resin is more preferably 3.0 to 40.0 mgKOH/g, or still more preferably 5.0 to 30.0 mgKOH/g.

The content of the above sulfonic acid-based resin is preferably 0.01 to 15.00 parts by mass with respect to 100 parts by mass of the binder resin from the viewpoint of compatibility between the low-temperature fixability and durable stability of the toner. The content of the sulfonic acid-based resin is more preferably 0.50 to 10.00 parts by mass, or still more preferably 2.00 to 5.00 parts by mass.

The above sulfonic acid-based resin preferably has a weight-average molecular weight (Mw) of 500 to 100,000 from the viewpoint of compatibility between the low-temperature fixability and durable stability of the toner. The Mw is more preferably 1,000 to 70,000, or still more preferably 5,000 to 50,000.

The above sulfonic acid-based resin preferably has a ratio (Mw/Mn) between the above Mw and a number-average molecular weight (Mn) of 1.50 to 20.00 from the viewpoint of compatibility between the low-temperature fixability and durable stability of the toner. The ratio is more preferably 2.00 to 10.00, or still more preferably 2.00 to 5.00.

The toner particles of the present invention each contain the colorant. Carbon black, a magnetic substance, or a product toned to a black color with yellow, magenta, and cyan colorants described below is utilized as a black colorant.

For example, any one of the following colorants can be used as a colorant for a cyan toner, magenta toner, or yellow toner.

As the yellow colorant, a compound typified by the following compounds are used: pigments such as a monoazo compound, a disazo compound, a condensed azo compound, an isoindolinone compound, an anthraquinone compound, an azo metal complex methine compound, and an allylamide compound. Specifically, the following pigments are preferably used: C.I. Pigment Yellow 3, 7, 10, 12 to 15, 17, 23, 24, 60, 62, 73, 74, 75, 83, 93 to 95, 99, 100, 101, 104, 108 to 111, 117, 120, 123, 128, 129, 138, 139, 147, 148, 150, 151, 154, 155, 166, 168 to 177, 179, 180, 181, 183, 185, 191:1, 191, 192, 193, 199, and 214.

As a dye, there are exemplified C.I. Solvent Yellow 33, 56, 79, 82, 93, 112, 162, and 163, and C.I. Disperse Yellow 42, 64, 201, and 211.

As the magenta colorant, there are used a monoazo compound, a condensed azo compound, a diketopyrrolopyrrole compound, anthraquinone, a quinacridone compound, a basic dye lake compound, a naphthol compound, a benzimidazolone compound, a thioindigo compound, and a perylene compound. Specific examples thereof include the following colorants.

There are exemplified: C.I. Pigment Red 2, 3, 5 to 7, 23, 48:2, 48:3, 48:4, 57:1, 81:1, 122, 144, 146, 150, 166, 169, 177, 184, 185, 202, 206, 220, 221, 238, 254, and 269; and C.I. Pigment Violet 19.

Examples of the cyan colorant that can be used include a copper phthalocyanine compound and a derivative thereof, an anthraquinone compound, and a base dye lake compound. Specific examples thereof include C.I. Pigment Blue 1, 7, 15, 15:1, 15:2, 15:3, 15:4, 60, 62, and 66.

One kind of those colorants may be used alone, or two or more kinds of them may be used as a mixture, and further, each of them may be used in the state of a solid solution. The colorant used in the present invention is selected in terms of its hue angle, chrome, lightness, weatherability, OHP transparency, and dispersing performance in the toner. The colorant is used so that its addition amount may be 0.4 to 20 parts by mass with respect to 100 parts by mass of the binder resin.

Further, the toner of the present invention may also be used as a magnetic toner incorporating a magnetic substance. In this case, the magnetic substance may serve also as a colorant. In the present invention, examples of the magnetic substance include: iron oxides such as magnetite, hematite, and ferrite; and metals such as iron, cobalt, and nickel. Also, there are exemplified metal alloys of those metals and metals such as aluminum, cobalt, copper, lead, magnesium, tin, zinc, antimony, beryllium, bismuth, cadmium, calcium, manganese, selenium, titanium, tungsten, or vanadium, and mixtures thereof.

Those magnetic substances, from the viewpoints of low-temperature fixability and durable stability of the toner, preferably have a number-average particle diameter of 2 μm or less and more preferably 0.1 to 0.5 μm. The content of the magnetic substance incorporated in the toner is preferably 20 to 200 parts by mass, and more preferably 40 to 150 parts by mass with respect to 100 parts by mass of the binder resin.

The above magnetic substance preferably has magnetic properties in an applied magnetic field of 796 kA/m (10 kOe), such as a coercive force (Hc) of 1.59 to 23.9 kA/m (20 to 300 Oe), a saturation magnetization (σs) of 50 to 200 $Am^2/kg$, and a residual magnetization (σr) of 2 to 20 $Am^2/kg$.

The toner of the present invention has the inorganic fine particles. It is preferred that the inorganic fine particles be externally added and mixed as a flowability-improving agent to and in the toner particles. Preferred examples of the inorganic fine particles include titanium oxide fine particles, silica fine particles, and alumina fine particles, and the silica fine particles are more preferred. In addition, in a preferred embodiment, the surfaces of those inorganic fine particles are subjected to a hydrophobic treatment. The inorganic fine particles are used in an amount of preferably 0.1 to 5 parts by mass, or more preferably 0.5 to 3.5 parts by mass with respect to 100 parts by mass of the toner particles.

The inorganic fine particles used in the toner of the present invention have a specific surface area based on nitrogen adsorption measured by a BET method in the range of preferably 30 $m^2/g$ or more, or particularly preferably 50 to 400 $m^2/g$ because such inorganic fine particles can provide good results.

An external additive intended for a purpose except the above improvement in flowability of the toner of the present invention such as an improvement in cleaning performance of the toner may be further externally added to and mixed in the toner particles as required.

Examples of the above external additive for the improvement in cleaning performance include fine particles each having a primary particle diameter in excess of 30 nm (preferably having a specific surface area of less than 50 $m^2/g$), and more preferred examples of the external additive include nearly spherical, inorganic or organic fine particles each having a primary particle diameter of 50 nm or more (preferably having a specific surface area of less than 30 $m^2/g$). Of those, spherical silica fine particles, spherical polymethylsilsesquioxane fine particles, or spherical resin fine particles are preferred.

Further, any one of the following other additives can be added as a developing performance-improving agent in a small amount to the toner of the present invention: a lubricant powder such as a fluororesin powder, a zinc stearate powder, and a polyvinylidene-fluoride powder; an abrasive such as a cerium oxide powder, a silicon carbide powder, and a strontium titanate powder; a caking controlling agent; a conductivity imparting agent such as a carbon black powder, a zinc oxide powder, and a tin oxide powder; organic fine particles having reverse polarity; or inorganic fine particles.

Each of those additives can also be used after its surface has been subjected to a hydrophobic treatment.

Any such external additive as described above is used in an amount of preferably 0.1 to 5 parts by mass, or more preferably 0.1 to 3 parts by mass with respect to 100 parts by mass of the toner particles.

The toner of the present invention can be produced by a method involving atomizing a molten mixture into the air with a disk or multi-fluid nozzle to provide substantially spherical toner particles or a method involving the employment of a dispersion polymerization method involving directly producing the toner particles with an aqueous organic solvent in which the polymerizable monomer is soluble and a polymer to be obtained is insoluble. Further, the toner can be produced by, for example, a method of producing the toner particles by employing an emulsion polymerization method or the like typified by a soap-free polymerization method involving directly polymerizing the polymerizable monomer in the presence of a water-soluble, polar polymerization initiator to produce the toner particles, a solution suspension method, an emulsion agglomeration method, or a suspension polymerization method.

The toner of the present invention is preferably produced by a production method including the step of forming the toner particles in water. Specific examples of the method include the following methods:

(1) a method based on the so-called suspension polymerization method of forming the toner particles including the steps of forming a water dispersion liquid of a monomer composition having at least the shell resin, the polymerizable monomer, the wax, and the colorant in water and polymerizing the polymerizable monomer of the water dispersion liquid;

(2) a method based on the so-called emulsion agglomeration method of forming the toner particles including the steps of forming a water dispersion liquid having at least resin particles each having the binder resin, the wax, and the colorant in water, agglomerating the resin particles in the water dispersion liquid to form a dispersion liquid of colored particles, and adding resin particles each having the shell resin to the dispersion liquid to coat the colored particles; and (3) a method based on the so-called solution suspension method of forming the toner particles including the steps of forming a resin composition having at least the binder resin, a solvent capable of dissolving the binder resin, the wax, and the colorant, dispersing the resin composition in water having the shell resin to form a water dispersion liquid, and removing the solvent from the water dispersion liquid.

The production method based on the suspension polymerization method in the above section (1) is particularly preferably employed as the production method for the toner of the present invention. The employment of the suspension polymerization method causes a graft bond between the shell resin and part of the binder resin in the polymerization process and uniformizes the contents of the shell resin in the toner particles, so the physical properties of the present invention may be exerted in an additionally favorable fashion.

A specific production method for the toner particles by the suspension polymerization method is as described below.

The polymerizable monomer, the shell resin, the colorant, the wax, and any other additive such as a charge control agent or crosslinking agent as required are uniformly dissolved or dispersed with a dispersing machine such as a homogenizer, a ball mill, a colloid mill, or an ultrasonic dispersing machine. A monomer composition thus obtained is suspended in an aqueous medium containing a dispersion stabilizer. In this case, the particle diameter distribution of the resultant toner particles is sharpened by providing each of the toner particles with a desired size in one stroke with a high-speed dispersing machine such as a high-speed stirring machine or an ultrasonic dispersing machine. The polymerization initiator may be added in advance to the monomer composition, or may be added after the monomer composition has been suspended in the aqueous medium.

After the suspension, the resultant has to be stirred with an ordinary stirring machine to such an extent that particle states are maintained, and the floating and sedimentation of the particles are prevented. It should be noted that, in the present invention, the aqueous medium preferably has a pH of 4 to 10.5 at the time of the suspension in terms of uniformity in toner shapes. When the pH is less than 4, the particle diameter distribution of the toner tends to be large. In addition, when the pH exceeds 10.5, the charging performance of the toner may reduce.

In the suspension polymerization method, a known surfactant or a known organic or inorganic dispersant can be used as a dispersion stabilizer. Of those, an inorganic dispersant can be preferably used because the stability thereof hardly collapses even when a reaction temperature is changed. Examples of such inorganic dispersants include the following compounds: polyvalent metal phosphates such as tricalcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; calcium hydroxide, magnesium hydroxide, aluminum hydroxide, silica, bentonite, and inorganic oxides such as alumina.

One kind alone, or a combination of two or more kinds, of those inorganic dispersants is used in an amount of preferably 0.2 to 20 parts by mass with respect to 100 parts by mass of a polymerizable monomer. Further, 0.001 to 0.1 part by mass of a surfactant with respect to 100 parts by mass of a polymerizable monomer may be used in combination when production of a finer toner is aimed. Examples of the surfactant include sodium dodecylbenzene sulfate, sodium tetradecyl sulfate, sodium pentadecyl sulfate, sodium octyl sulfate, sodium oleate, sodium laurate, sodium stearate, and potassium stearate.

Although each of those inorganic dispersants may be used as it is, the particles of each of the inorganic dispersants are preferably produced in an aqueous medium in order that finer particles may be obtained. Specifically, in the case of tricalcium phosphate, poorly water-soluble tricalcium phosphate can be produced by mixing an aqueous solution of sodium phosphate and an aqueous solution of calcium chloride under high-speed stirring, and dispersion with additional uniformity and additional fineness can be attained. Any such inorganic dispersant can be removed in a nearly complete fashion by being dissolved with an acid or alkali after the completion of the polymerization.

In the polymerizing step of the above suspension polymerization method, the polymerization is performed at a temperature set to 40° C. or higher, or generally 50 to 100° C. When the polymerization is performed in the temperature range, the binder resin and the wax undergo a phase separation as the polymerization progresses. As a result, toner particles in each of which the wax is included are obtained. It is also preferred that the temperature be raised to 90 to 150° C. at a terminal stage of the polymerization reaction.

In the present invention, in the polymerizing step in each of the above suspension polymerization method and any other polymerization method, the polymerization is preferably performed under the condition that a temperature at the time of the initiation of the polymerization is set to be higher than the 10-hour half-life temperature (° C.) of the polymerization initiator by 15.0 to 50.0° C. Because a radical concentration at the initial stage of the polymerization can be made high, many molecular chains having a uniform molecular weight can be produced from an early stage of the polymerizing step. As a result, a crosslinking between the molecular chains can be easily suppressed, and the content of each of the THF insoluble matter and the IPA soluble matter of the toner can be suitably controlled. In addition, when the above shell resin is used, the shell resin and part of the binder resin are easily graft-bonded, so adhesiveness between the shell resin and the binder resin easily improves. It should be noted that the temperature at the time of the initiation of the polymerization is higher than the 10-hour half-life temperature (° C.) of the polymerization initiator by more preferably 25.0 to 50.0° C., or still more preferably 30.0 to 50.0° C.

In the present invention, in the polymerizing step in each of the above suspension polymerization method and any other polymerization method, the polymerization is preferably performed under the condition that the temperature at the time of the initiation of the polymerization is set to be higher than the glass transition point (Tg) (° C.) of the binder resin produced by the polymerization by 30.0 to 70.0° C. Because the motion of the molecular chains of the binder resin during the polymerization becomes intense, the crosslinking can be easily suppressed, and the content of each of the THF insoluble matter and the IPA soluble matter can be suitably controlled. In addition, when the above shell resin is used, the shell resin and part of the binder resin are easily graft-bonded, so the adhesiveness between the shell resin and the binder resin easily improves. It should be noted that the temperature at the time of the initiation of the polymerization is higher than the glass transition point (Tg) (° C.) of the binder resin by more preferably 35.0 to 60.0° C., or still more preferably 35.0 to 50.0° C.

The toner of the present invention can be used in a one-component developer, or can be used in a two-component developer having the toner and a carrier.

When the toner is used in the two-component developer, a developer obtained by mixing the toner of the present invention and the carrier is used. The carrier may be any one of known carriers. Examples thereof include a carrier which is formed of an element selected from iron, copper, zinc, nickel, cobalt, manganese, and chromium elements, and a ferrite carrier formed of a composite oxide of iron and any other element. Alternative examples include a magnetic substance-containing resin carrier obtained by dispersing a magnetic substance in a resin and a resin-filled carrier obtained by filling a pore of a porous magnetic substance with a resin. The form of the carrier which may be used may be any one of a sphere, a substantially spherical shape, a flat form, and an amorphous form. Of those, the carrier is preferably a magnetic carrier having a resin component in its surface and having a true density of 2.5 to 4.2 g/cm$^3$.

The above carrier used in the two-component developer (or replenishing two-component developer) has a 50% particle diameter on a volume basis (D50) of preferably 15 to 70 μm, more preferably 20 to 70 μm, or still more preferably 25 to 60 μm. When the 50% particle diameter on a volume basis (D50) of the magnetic carrier falls within the range, good images each of which is free of fogging and has good dot reproducibility can be obtained over a long time period. When the 50% particle diameter on a volume basis (D50) of the carrier is less than 15 μm, the flowability of the carrier reduces, and the durable stability of the toner reduces in some cases. When the 50% particle diameter on a volume basis (D50) exceeds 70 μm, the carrier has so large a particle diameter that the density of magnetic brushes becomes low and the graininess of an image is raised in some cases.

The particle diameter of the carrier can be caused to fall within the above range by classification with, for example, an air classifier (Elbow Jet Lab EJ-L3, manufactured by Nittetsu Mining Co., Ltd.).

A method of measuring the above 50% particle diameter on a volume basis (D50) is described later.

The above carrier has a true density of preferably 2.5 to 4.2 g/cm$^3$, more preferably 2.7 to 4.1 g/cm$^3$, or still more preferably 3.0 to 4.0 g/cm$^3$. Because the true density of the carrier is small, a phenomenon in which the toner or the carrier deteriorates in a developing machine is suppressed. A method of measuring the true density of the carrier is described later.

The above carrier preferably has an intensity of magnetization of 40 to 70 μm$^2$/kg in a magnetic field of 1,000/4π (kA/m). When the intensity of magnetization of the carrier falls within the range, good images each having good dot reproducibility can be obtained over a long time period. A method of measuring the intensity of magnetization is described later.

The carrier preferably has an average circularity of 0.85 to 0.95 and preferably contains 90 percentage number or more of particles having a circularity of 0.80 or more. The average circularity of the carrier is more preferably 0.87 to 0.93, and still more preferably 0.88 to 0.92. The average circularity is a coefficient indicating a spherical shape of a particle and is determined from a maximum particle diameter and a measured particle projected area. An average circularity of 1.00 indicates that a particle has a true spherical shape (true circle), and the average circularity indicates that the more the value drops, the more elongated shape or the more amorphous shape a particle has. When the average circularity of the carrier is 0.85 to 0.95, the carrier has sufficient strength, is excellent in charge-providing performance for the toner, hardly undergoes the adhesion of the toner or a toner component, and is excellent in durability. A method of measuring the average circularity of the carrier is described later.

When the toner and the carrier are mixed so as to be used as a two-component developer in a developing device, a mixing ratio between the toner and the carrier is as follows, in which the toner is used in an amount of preferably 0.02 to 0.35 part by mass, more preferably 0.04 to 0.25 part by mass, or particularly preferably 0.05 to 0.20 part by mass with respect to 1 part by mass of the carrier.

<Measurement of True Density of Toner and Carrier>

The true density of the toner and the carrier can be measured by a method involving the use of a gas-replaced pycnometer. The measurement principle is as described below. A shut-off valve is provided between a sample chamber (having a volume $V_1$) and a comparison chamber (having a volume $V_2$) each having a constant volume, and the mass ($M_0$ (g)) of a sample is measured in advance before the sample is loaded into the sample chamber. The inside of each of the sample chamber and the comparison chamber is filled with an inert gas such as helium, and a pressure at that time is represented by $P_1$. The shut-off valve is closed, an inert gas is added only to the sample chamber, and a pressure at that time is represented by $P_2$. A pressure in a system when the shut-off valve is opened so that the sample chamber and the comparison chamber are connected to each other is represented by $P_3$. The volume ($V_0$ ($cm^3$)) of the sample can be determined from the following equation A. The true density ρ ($g/cm^3$) of the toner and the carrier can be determined from the following equation B.

$$V_0=V_1-[V_2/\{(P_2-P_1)/(P_3-P_1)-1\}] \quad \text{(equation A)}$$

$$\rho=M_0/V_0 \quad \text{(equation B)}$$

In the above method, the present invention used a dry automatic densimeter Accupyc 1330 (manufactured by Shimadzu Corporation) to conduct the measurement. At that time, a 10-$cm^3$ sample container is used, and a helium gas purge is performed at a maximum pressure of 19.5 psig (134.4 kPa) ten times as a sample pretreatment. After that, a fluctuation in pressure in the sample chamber of 0.0050 psig/min is used as an index for judging whether the pressure in the container reaches equilibrium. If the fluctuation is equal to or lower than the value, the pressure is regarded as being in an equilibrium state, so measurement is initiated, and the true density is automatically measured. The measurement is performed five times, and the average of the five measured values is determined and defined as the true density ($g/cm^3$).

<Molecular Weight Measurement in Terms of Polystyrene (PSt) by Gel Permeation Chromatography (GPC)>

In the present invention, a weight-average molecular weight (Mw), a number-average molecular weight (Mn), and the peak molecular weight (Mp) of a molecular weight distribution obtained by GPC are values determined by the following method.

First, 30 mg of a sample to be subjected to the measurement are loaded into 5 ml of tetrahydrofuran (THF), and the mixture is left at rest at room temperature for 24 hours. Then, the resultant is filtrated with a disposable filter for a high-performance liquid chromatograph (HPLC) "Maishori Disk E-1-25-5" (manufactured by TOSOH CORPORATION) so that a sample solution may be obtained. The measurement is performed with the sample solution under the following conditions.

Apparatus: HLC 8120 GPC (detector: RI) (manufactured by Tosoh Corporation)

Column: septuplicate of Shodex KF-801, 802, 803, 804, 805, 806, and 807 (manufactured by Showa Denko K. K.)

Eluent: tetrahydrofuran (THF)

Flow rate: 1.0 ml/min

Oven temperature: 40.0° C.

Sample injection amount: 0.10 ml

A molecular weight calibration curve obtained by using the following standard sample is used to calculate the molecular weight of a sample: standard polystyrene Easical PS-1 (a mixture of polystyrenes each having a molecular weight of 7,500,000, 841,700, 148,000, 28,500, and 2,930 and a mixture of polystyrenes each having a molecular weight of 2,560,000, 320,000, 59,500, 9,920, and 580) and PS-2 (a mixture of polystyrenes each having a molecular weight of 377,400, 96,000, 19,720, 4,490, and 1,180, and a mixture of polystyrenes each having a molecular weight of 188,700, 46,500, 9,920, 2,360, and 580) manufactured by Polymer Laboratories Ltd. An RI (refractive index) detector is used as the detector.

<Measurement of Content of THF Soluble or Insoluble Matter, Content of 2-Propanol (IPA) Soluble Matter, and Content of Methanol Insoluble Matter of Each of Toner and Resin to be Used>

The contents are measured by the following Soxhlet extraction method.

Extraction thimble (a No. 86R manufactured by Toyo Roshi is used) is dried in a vacuum at a temperature of 40° C. for 24 hours. After that, the extraction thimble is left under an environment adjusted to have a temperature of 25° C. and a humidity of 60% RH for 3 days. About 2.0 g of a sample to be subjected to the measurement are weighed on the extraction thimble, and the weight of the sample at the time is represented by W1 (g). The sample is extracted with a Soxhlet extractor and 200 ml of THF, IPA, or methanol as a solvent in an oil bath having a temperature of 90° C. for 24 hours. After that, the extraction thimble is silently taken out, and is then dried in a vacuum at a temperature of 40° C. for 24 hours. The extraction thimble is left under an environment adjusted to have a temperature of 25° C. and a humidity of 60% RH for 3 days. After that, the amount of a solid remaining on the extraction thimble is weighed, and the weight is represented by W2 (g). The content of THF soluble or insoluble matter, the content of IPA soluble matter, or the content of methanol insoluble matter is calculated from one of the following equations.

$$\text{Content (mass \%) of THF or methanol insoluble matter of sample}=(W2/W1)\times 100$$

$$\text{Content (mass \%) of THE or IPA soluble matter of sample}=100-(W2/W1)\times 100$$

A sample obtained by the following procedure is used in a fluorescent X-ray measurement for the THF soluble matter, the procedure including a resin component being recovered by removing THF in the solution extracted with the above Soxhlet extractor by distillation, and then being dried in a vacuum at a temperature of 40° C. for 24 hours.

<Measurement of Glass Transition Point (Tg) of Each of Toner and Resin to be Used, Melting Point (Tm) of Wax, and Temperature and Endotherm of Highest Endothermic Peak of Toner>

Figure 1:
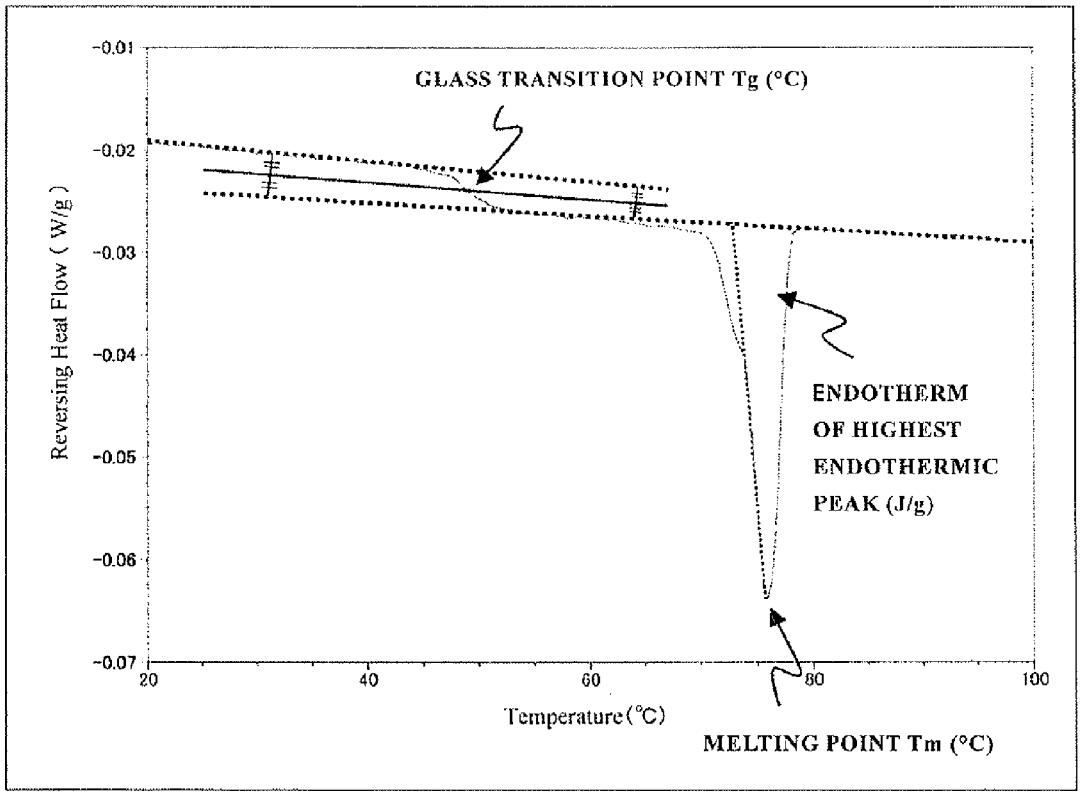
FIG. 1 is a conceptional view illustrating a method of measuring each of a Tg, a Tm, and an endotherm of the highest endothermic peak with a differential scanning calorimeter (DSC).

In the present invention, a glass transition point (Tg), melting point (Tm), and the temperature and endotherm of the highest endothermic peak are measured with a differential scanning calorimeter (DSC). To be specific, Q1000 (manufactured by TA Instruments) is utilized as the DSC. A measurement method is as described below. 4 mg of a sample are precisely weighed in an aluminum pan, and measurement is performed by using an empty aluminum pan as a reference pan under a nitrogen atmosphere at a modulation amplitude of 0.5° C. and a frequency of 1/min. A reversing heat flow curve obtained by scanning at a measurement temperature retained at 10° C. for 10 minutes and then increased at a rate of temperature increase of 1° C./min from 10° C. to 180° C. is defined as a DSC curve, and Tg is determined from the curve by a middle point method. It should be noted that a glass transition point determined by the middle point method is defined as a point of intersection of a middle line, which is placed between a base line before an endothermic peak and a base line after the endothermic peak, and a rise-up curve in a DSC curve at the time of temperature increase (see FIG. 1).

The temperature and endotherm of the highest endothermic peak of the toner are measured as described below. In a reversing heat flow curve obtained as a result of the same measurement as described above, a straight line is drawn to connect the point at which an endothermic peak leaves the extrapolated line of a base line before the endothermic peak and the point at which the extrapolated line of the base line after the completion of the endothermic peak and the endothermic peak contact with each other. The temperature at which the endothermic peak shows a local maximum value in the region surrounded by the straight line and the endothermic peak is defined as the temperature of the highest endothermic peak. When the peak shows two or more local maximum values, the temperature at the local maximum value that is most distant from the connecting straight line in the surrounded region is defined as the temperature of the highest endothermic peak. When two or more independent surrounded regions are present, the temperature at the local maximum value that is most distant from a straight line connecting points in the same manner as that described above is similarly defined as the temperature of the highest endothermic peak.

The endotherm is determined as described below. In the reversing heat flow curve obtained by the above measurement, a straight line is drawn to connect the point at which an endothermic peak leaves the extrapolated line of a base line before the endothermic peak and the point at which the extrapolated line of the base line after the completion of the endothermic peak and the endothermic peak contact with each other. The area of the region surrounded by the straight line and the endothermic peak (integration value of a melt peak) is determined to be the endotherm (J/g). When two or more independent surrounded regions are present, the sum of the areas of the regions is defined as the endotherm.

The melting point of the wax is the temperature of the highest endothermic peak measured in the same manner as in the above method of measuring the temperature of the highest endothermic peak of the toner.

<Measurement of Acid Value of Resin>

An acid value of the resin is determined as described below. A basic operation is in conformance with JIS-K0070.

The number of milligrams of potassium hydroxide required for neutralizing free fatty acid, an acid radical of a resin, and the like contained in 1 g of a sample is called an acid value, and is measured by the following method.

(1) Reagent (a) Preparation of Solvent

As a solvent for a sample, a mixed liquid of ethyl ether and ethyl alcohol (1+1 or 2+1) or a mixed liquid of benzene and ethyl alcohol (1+1 or 2+1) is used, and any such solution is neutralized with a 0.1-mol/l solution of potassium hydroxide in ethyl alcohol immediately before the use of the solution by using phenolphthalein as an indicator.

(b) Preparation of Phenolphthalein Solution 1 g of phenolphthalein is dissolved in 100 ml of ethyl alcohol (95 v/v %).

(c) Preparation of 0.1-mol/l Solution of Potassium Hydroxide in Ethyl Alcohol 7.0 g of potassium hydroxide are dissolved in as small an amount as possible of water. Ethyl alcohol (95 v/v %) is added to the solution so that the mixture has a volume of 1 l. The mixture is left to stand for 2 to 3 days, and is then filtrated. Standardization is performed in conformance with JIS-K8006 (basic item concerning titration during content test for reagent).

(2) Operation 1 to 20 g of a sample are precisely weighed, and 100 ml of the solvent and several drops of a phenolphthalein solution as an indicator are added to the sample. The mixture is sufficiently shaken until the sample completely dissolves. In the case of a solid sample, the sample is dissolved by heating the mixture on a water bath. After having been cooled, the resultant is titrated with a 0.1-mol/l solution of potassium hydroxide in ethyl alcohol, and the amount of the solution in which the faint red color of the indicator continues for 30 seconds is defined as the end point of the neutralization.

(3) Calculation Equation

The acid value of the sample is calculated from the following equation.

$$A=(B\times f\times 5.611)/S$$

A: acid value (mgKOH/g)

B: used amount (ml) of 0.1-mol/l solution of potassium hydroxide in ethyl alcohol f: factor of 0.1-mol/l solution of potassium hydroxide in ethyl alcohol S: sample (g)

The hydroxyl value of the resin is determined as described below. The basic operation is in conformance with JIS-K0070.

The number of milligrams of potassium hydroxide needed for neutralizing acetic acid bonded to hydroxyl groups when 1 g of a sample is acetylated by a stipulated method is called a hydroxyl value, and is measured by the following method.

(1) Reagent (a) Preparation of Acetylating Reagent

First, 25 ml of acetic anhydride are loaded into a 100-ml measuring flask, and pyridine is added to the flask so that the total amount of acetic anhydride and pyridine may be 100 ml. Then, the flask is sufficiently shaken so that acetic anhydride and pyridine may be mixed (pyridine may be added in some cases). Attention is paid so that the resultant acetylating reagent may be out of contact with moisture, a carbon dioxide gas, and the vapor of an acid, and the reagent is stored in a brown bottle.

(b) Preparation of Phenolphthalein Solution 1 g of phenolphthalein is dissolved in 100 ml of ethyl alcohol (95 v/v %).

(c) Preparation of 0.2-mol/l Solution of Potassium Hydroxide in Ethyl Alcohol 35 g of potassium hydroxide are dissolved in as small an amount as possible of water. Ethyl alcohol (95 v/v %) is added to the solution so that the mixture has a volume of 1 l. The mixture is left to stand for 2 to 3 days, and is then filtrated. Standardization is performed with JIS-K8006.

(2) Operation 0.5 to 20 g of a sample are precisely weighed in a round-bottom flask, and 5 ml of the acetylated reagent are precisely added to the sample. A small funnel is placed on the opening of the flask, and the flask is heated by immersing a portion corresponding to a height of up to about 1 cm from the bottom of the flask in a glycerin bath having a temperature of 95 to 100° C. In this case, the base of the neck of the flask is coated with a disk made of cardboard perforated with a round hole at its center in order that the neck of the flask may be prevented from receiving heat from the bath to have an increased temperature. After having been immersed for 1 hour, the flask is taken out of the bath and left standing to cool. After that, 1 ml of water is added from the funnel to the flask, and the flask is shaken so that acetic anhydride may be decomposed. Further, the flask is heated in the glycerin bath again for 10 minutes in order that the decomposition may be perfect. After the flask has been left standing to cool, the walls of the funnel and the flask are washed with 5 ml of ethyl alcohol, and the resultant solution is titrated with a 0.2-mol/l solution of potassium hydroxide in ethyl alcohol while a phenolphthalein solution is used as an indicator. It should be noted that a blank test is performed in tandem with the test. In some cases, a KOH-THF solution may be used as an indicator.

(3) Calculation Equation

The hydroxyl value of the sample is calculated from the following equation.

$$A=\{(B-C)\times f\times 28.05/S\}+D$$

A: hydroxyl value (mgKOH/g)

B: used amount (ml) of 0.2-mol/l solution of potassium hydroxide in ethyl alcohol in the blank test C: used amount (ml) of 0.2-mol/l solution of potassium hydroxide in ethyl alcohol in the test f: factor of 0.2-mol/l solution of potassium hydroxide in ethyl alcohol S: sample (g)

D: acid value (mgKOH/g)

<Measurement of Average Circularity and Standard Deviation of Circularity of Toner>

The average circularity of the toner particles is measured with a flow-type particle image analyzer "FPIA-3000" (manufactured by SYSMEX CORPORATION) under measurement and analysis conditions at the time of a calibration operation.

A specific measurement method is as described below. First, about 20 ml of ion-exchanged water from which an impure solid and the like have been removed in advance are charged into a container made of glass. Then, about 0.2 ml of a diluted solution prepared by diluting a "Contaminon N" (a 10-mass % aqueous solution of a neutral detergent for washing a precision measuring unit formed of a nonionic surfactant, a cationic surfactant, and an organic builder and having a pH of 7, manufactured by Wako Pure Chemical Industries, Ltd.) with ion-exchanged water by about three mass fold is added as a dispersant to the container. Further, about 0.02 g of a measurement sample is added to the container, and the mixture is subjected to a dispersion treatment with an ultrasonic dispersing unit for 2 minutes so that a dispersion liquid for measurement may be obtained. At that time, the dispersion liquid is appropriately cooled so as to have a temperature of 10° C. or higher and 40° C. or lower. A desktop ultrasonic cleaning and dispersing unit having an oscillatory frequency of 50 kHz and an electrical output of 150 W (such as a "VS-150" (manufactured by VELVO-CLEAR)) is used as the ultrasonic dispersing unit. A predetermined amount of ion-exchanged water is charged into a water tank, and about 2 ml of the Contaminon N are added to the water tank.

The flow-type particle image analyzer mounted with "UPlanApro" as an objective lens (at a magnification of 10 and a numerical aperture of 0.40) is used in the measurement, and a particle sheath "PSE-900A" (manufactured by SYSMEX CORPORATION) is used as the sheath liquid. The dispersion liquid prepared in accordance with the procedure is introduced into the flow-type particle image analyzer, and the particle diameters of 3,000 toner particles are measured according to the total count mode of an HPF measurement mode. Then, the average circularity of the toner particles is determined with a binarization threshold at the time of particle analysis set to 85% and particle diameters to be analyzed limited to ones each corresponding to a circle-equivalent diameter of 1.985 μm or more and less than 39.69 μm.

Upon measurement, prior to the initiation of the measurement, automatic focusing is performed by using standard latex particles (obtained by diluting, for example, "RESEARCH AND TEST PARTICLES Latex Microsphere Suspensions 5200A" manufactured by Duke Scientific with ion-exchanged water). After that, focusing is preferably performed every two hours from the initiation of the measurement.

It should be noted that, in examples of the present invention, a flow-type particle image analyzer in which calibration was conducted by SYSMEX CORPORATION, and which received a calibration certificate issued by SYSMEX CORPORATION is used, and the measurement is performed under measurement and analysis conditions identical to those at the time of the reception of the calibration certificate except that particle diameters to be analyzed are limited to ones each corresponding to a circle-equivalent diameter of 1.985 μm or more and less than 39.69 μm.

<Measurement of Particle Diameter of Toner>

To be specific, the weight-average particle diameter D4 (μm) and number-average particle diameter D1 (μm) of the toner can each be measured by the following method.

As the apparatus, a precision grain size distribution measuring apparatus based on a pore electrical resistance method provided with a 100-μm aperture tube "COULTER COUNTER MULTISIZER 3" (registered trademark, manufactured by Beckman Coulter, Inc.) is used. For setting measurement conditions and analyzing measurement data, dedicated software included with the apparatus "BECKMAN COULTER MULTISIZER 3 Version 3.51" (manufactured by Beckman Coulter, Inc.) is used. It should be noted that measurement is performed while the number of effective measurement channels is set to 25,000.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software is set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement button". In addition, a current is set to 1,600 μA, a gain is set to 2, and an electrolyte solution is set to an ISOTON II, and a check mark is placed in a check box on "flush of aperture tube after the measurement".

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the dedicated software.

(2) About 30 ml of the electrolyte solution are charged into a 100-ml flat bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by about three mass-fold are added as a dispersant to the electrolyte solution.

(3) An ultrasonic dispersing unit "ULTRASONIC DISPERSION SYSTEM TETORA 150" (manufactured by Nikkaki Bios Co., Ltd.) in which two oscillators each having an oscillatory frequency of 50 kHz are built so as to be out of phase by 180° and which had an electrical output of 120 W is prepared. A predetermined amount of ion-exchanged water is charged into the water tank of the ultrasonic dispersing unit. About 2 ml of the Contaminon N are added to the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte solution in the section (5) in which the toner was dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) and the number-average particle diameter (D1) of the toner is calculated. It should be noted that an "average diameter" on the "analysis/volume statistics (arithmetic average)" screen of the dedicated software when the dedicated software is set to show a graph in a vol % unit is the weight-average particle diameter (D4), and the "average diameter" on the "analysis/number statistics (arithmetic average)" screen of the dedicated software when the dedicated software is set to show a graph in a num % unit is the number-average particle diameter (D1).

<Measurement of Content of Sulfur Element Originating from Sulfonic Groups>

The measurement is performed with a wavelength-dispersive fluorescent X-ray analyzer "AXIOS ADVANCED" (manufactured by PANalytical). First, about 3 g of a sample are loaded into a ring made of vinyl chloride for 27 mm measurement, and are pressed at 200 kN so that the sample may be molded. The amount of the sample used here and the thickness of the sample after the molding are measured, and the content of a sulfur element originating from sulfonic groups is determined as an input value for calculating a content. Analysis conditions and an analysis method are described below.

(Analysis Condition)

Quantification method: fundamental parameter method

Analysis element: measured were each element from boron (B) to uranium (U) in the periodic table.

Measurement atmosphere: vacuum

Measurement sample: solid

Collimator mask diameter: 27 mm

Measurement condition: an automatic program initially set to an optimum excitation condition for each element was used.

Measurement time: approximately 20 minutes

General values recommended by the apparatus were used for the other parameters.

(Analysis Method)

Analysis program: UniQuant 5

Analysis condition: oxide morphology

Balance component: $CH_2$

General values recommended by the apparatus were used for the other parameters.

<50% Particle Diameter on Volume Basis (D50) and Average Circularity of Carrier>

The 50% particle diameter on a volume basis (D50) and average circularity of the carrier are measured with a MULTI-IMAGE ANALYZER (manufactured by Beckman Coulter, Inc.) as described below.

A solution prepared by mixing an aqueous solution of NaCl having a concentration of about 1% and glycerin at 50 vol %:50 vol % is used as an electrolyte solution. Here, the aqueous solution of NaCl has only to be prepared by using first grade sodium chloride, or, for example, an ISOTON (registered trademark)-II (manufactured by Coulter Scientific Japan, Co.) may also be used as the aqueous solution. Glycerin has only to be a reagent grade or first grade reagent.

First, 0.1 to 1.0 ml of a surfactant (preferably an alkyl benzenesulfonate) as a dispersant is added to the electrolyte solution (about 30 ml). Further, 2 to 20 mg of a measurement sample are added to the mixture. The electrolyte solution in which the sample has been suspended is subjected to a dispersion treatment with an ultrasonic dispersing unit for about 1 minute so that a dispersion liquid may be obtained.

The circle-equivalent diameters and circularities of the particles of the carrier are calculated with a 200-μm aperture as an aperture and a lens having a magnification of 20 under the following measurement conditions.

| | |
|---|---|
| Average brightness in measurement frame: | 220 to 230 |
| Measurement frame setting: | 300 |
| Threshold (SH): | 50 |
| Binarization level: | 180 |

The electrolyte solution and the dispersion liquid are charged into a glass measurement container, and the concentration of the carrier particles in the measurement container is set to 5 to 10 vol %. The contents in the glass measurement container are stirred at the maximum stirring speed. A suction pressure for the sample is set to 10 kPa. When the carrier has so large a specific gravity as to be apt to sediment, a time period for the measurement is set to 15 to 30 minutes. In addition, the measurement is suspended every 5 to 10 minutes, and the container is replenished with the sample liquid and the mixed solution of the electrolyte solution and glycerin.

The number of measured particles is 2,000. After the completion of the measurement, blurred images, agglomerated particles (multiple particles are simultaneously subjected to the measurement), and the like are removed from a particle image screen with software in the main body of the apparatus.

The circularity and the circle-equivalent diameter of the carrier are calculated from the following equation.

$$\text{Circularity}=(4\times\text{Area})/(\text{MaxLength}^2\times\pi)$$

$$\text{Circle-equivalent diameter}=(4\cdot\text{Area}/\pi)^{1/2}$$

The term "Area" as used herein is defined as the projected area of a binarized carrier particle image while the term "MaxLength" as used herein is defined as the maximum diameter of the carrier particle image. The circle-equivalent diameter is represented as the diameter of a true circle when the "Area" is regarded as the area of the true circle. The resultant circle-equivalent diameters are classified into 256 divisions ranging from 4 to 100 μm, and are plotted on a logarithmic graph on a volume basis. The 50% particle diameter on a volume basis (D50) is determined by using the graph. The average circularity is determined by dividing the sum of the circularities of the respective particles by the total number of the particles.

<Measurement of Intensity of Magnetization of Carrier>

The intensity of magnetization of the carrier can be determined with, for example, a vibrating sample magnetometer (VSM) or a DC magnetizing property recorder (B-H tracer). The intensity of magnetization can be preferably measured with the VSM. A vibration magnetic field-type magnetic property automatic recorder BHV-30 manufactured by Riken Denshi. Co., Ltd. is included in examples of the VSM. The intensity of magnetization can be measured with the recorder by the following procedure. The carrier is closely packed into a cylindrical plastic container to a sufficient extent, and, in the meantime, an external magnetic field of 1,000/4π (kA/m) (1,000 Oe) is generated. In the state, the magnetizing moment of the carrier packed into the container is measured. Further, the actual mass of the carrier packed into the container is measured, and the intensity of magnetization ($Am^2/kg$) of the carrier is determined.

EXAMPLES

Hereinafter, the present invention is described specifically by way of production examples and examples. However, the present invention is by no means limited to those production examples and examples. It should be noted that, when there is no particular description therefor, the number of parts in the following composition refers to "parts by mass".

Styrene Acrylic Resin Production Example 1

The following materials were loaded into a pressure-resistant container A provided with a stirring machine and a nitrogen-introducing pipe under a nitrogen atmosphere.

| | |
|---|---|
| Toluene: | 20 parts by mass |

The temperature of a container B connected to the above container A and provided with a flow rate-adjusting function was held at 0° C., and the following materials were loaded into the container B.

| | |
|---|---|
| Styrene (St): | 81.5 parts by mass |
| Toluene (Tol1): | 18.5 parts by mass |

The temperature of a container C connected to the above container A and provided with a flow rate-adjusting function was held at 0° C., and the following materials were loaded into the container C.

| | |
|---|---|
| n-butyl acrylate (Ba): | 14.3 parts by mass |
| Methyl methacrylate (MMA): | 2.4 parts by mass |
| Methacrylic acid (MAA): | 1.8 parts by mass |
| Toluene (Tol2): | 21.5 parts by mass |

The temperature of a container D connected to the above container A and provided with a flow rate-adjusting function was held at −10° C., and the following materials were loaded into the container D.

| | |
|---|---|
| Di-t-butyl peroxide (PBD): | 7.6 parts by mass |
| Toluene (Tol3): | 32.4 parts by mass |

A flow rate upon loading from the container B to the container A was set to 25 parts by mass/h. A flow rate upon loading from the container C to the container A was set as follows, in which the flow rate was initially 8 parts by mass/h, and was increased at a constant acceleration so as to be 12 parts by mass/h in 4 hours. A flow rate upon loading from the container D to the container A was set to 10 parts by mass/h. The content in the container A was stirred at 200 revolutions per minute, and was heated to 140° C. Then, simultaneous loading of the respective materials from the containers B, C, and D was initiated. After the loading of all the materials had been completed, the resultant mixture was stirred for an additional three hours. The solvent was removed by distillation. As a result, a styrene acrylic resin 1 was obtained. Table 2 shows the physical properties of the styrene acrylic resin 1.

Styrene Acrylic Resin Production Examples 2, 3, and 6

Styrene acrylic resins 2, 3, and 6 were each obtained in the same manner as in Styrene Acrylic Resin Production Example 1 except that the conditions were changed to those shown in Table 1. Table 2 shows the physical properties of the styrene acrylic resins 2, 3, and 6.

Styrene Acrylic Resin Production Example 4

The following materials were loaded into a pressure-resistant container A provided with a stirring machine and a nitrogen-introducing pipe under a nitrogen atmosphere.

| | |
|---|---|
| Toluene: | 20 parts by mass |

The temperature of a container B connected to the above container A and provided with a flow rate-adjusting function was held at 0° C., and the following materials were loaded into the container B.

| | |
|---|---|
| Styrene (St): | 70.6 parts by mass |
| Toluene (Tol1): | 29.4 parts by mass |

The temperature of a container C connected to the above container A and provided with a flow rate-adjusting function was held at 0° C., and the following materials were loaded into the container C.

| | |
|---|---|
| n-butyl acrylate (Ba): | 20.0 parts by mass |
| Methyl methacrylate (MMA): | 4.8 parts by mass |
| Methacrylic acid (MAA): | 1.8 parts by mass |
| 2-hydroxyethyl methacrylate (HEMA): | 2.8 parts by mass |
| Toluene (Tol2): | 10.6 parts by mass |

The temperature of a container D connected to the above container A and provided with a flow rate-adjusting function was held at −10° C., and the following materials were loaded into the container D.

| | |
|---|---|
| Di-t-butyl peroxide (PBD): | 5.4 parts by mass |
| Toluene (Tol3): | 34.6 parts by mass |

A flow rate upon loading from the container B to the container A was set to 25 parts by mass/h. A flow rate upon loading from the container C to the container A was set to 10 parts by mass/h, and a flow rate upon loading from the container D to the container A was set to 10 parts by mass/h. The content in the container A was stirred at 200 revolutions per minute, and was heated to 140° C. Then, simultaneous loading of the respective materials from the containers B, C, and D was initiated. After the loading of all the materials had been completed, the resultant mixture was stirred for an additional three hours. The solvent was removed by distillation. As a result, a styrene acrylic resin 4 was obtained. Table 2 shows the physical properties of the styrene acrylic resin 4.

Styrene Acrylic Resin Production Examples 5 and 9

Styrene acrylic resins 5 and 9 were each obtained in the same manner as in Styrene Acrylic Resin Production Example 4 except that the conditions were changed to those shown in Table 1. Table 2 shows the physical properties of the styrene acrylic resins 5 and 9.

Styrene Acrylic Resin Production Example 7

The following materials were loaded into a reaction vessel provided with a reflux condenser, a stirring machine, and a nitrogen-introducing pipe under a nitrogen atmosphere.

| | |
|---|---|
| Styrene (St): | 81.5 parts by mass |
| Toluene (Tol1): | 100 parts by mass |
| n-butyl acrylate (Ba): | 14.3 parts by mass |
| Methyl methacrylate (MMA): | 2.4 parts by mass |
| Methacrylic acid (MAA): | 1.8 parts by mass |
| Di-t-butyl peroxide (PBD): | 7.2 parts by mass |

The content in the vessel was stirred at 200 revolutions per minute, was heated to 110° C., and was stirred for 10 hours. Further, the resultant was heated to 140° C. and polymerized for 6 hours. The solvent was removed by distillation. As a result, a styrene acrylic resin 7 was obtained. Table 2 shows the physical properties of the styrene acrylic resin 7.

Styrene Acrylic Resin Production Example 8

Styrene acrylic resin 8 was obtained in the same manner as in Styrene Acrylic Resin Production Example 7 except that the conditions were changed to those shown in Table 1. Table 2 shows the physical properties of the styrene acrylic resin 8.

TABLE 1

| Production Example | Resin | St amount (parts by mass) | Tol1 amount (parts by mass) | Flow rate (parts by mass/h) | Ba amount (parts by mass) | MMA amount (parts by mass) | MAA amount (parts by mass) | HEMA amount (parts by mass) |
|---|---|---|---|---|---|---|---|---|
| Styrene Acrylic Resin Production Example 1 | Styrene acrylic resin 1 | 81.5 | 18.5 | 25 | 14.3 | 2.4 | 1.8 | 0 |
| Styrene Acrylic Resin Production Example 2 | Styrene acrylic resin 2 | 92 | 8 | 25 | 3.2 | 2.4 | 2.4 | 0 |
| Styrene Acrylic Resin Production Example 3 | Styrene acrylic resin 3 | 95.8 | 4.2 | 25 | 0 | 2.4 | 1.8 | 0 |
| Styrene Acrylic Resin Production Example 4 | Styrene acrylic resin 4 | 70.6 | 29.4 | 25 | 20 | 4.8 | 1.8 | 2.8 |
| Styrene Acrylic Resin Production Example 5 | Styrene acrylic resin 5 | 86 | 4 | 30 | 4 | 6.4 | 3.6 | 0 |
| Styrene Acrylic Resin Production Example 6 | Styrene acrylic resin 6 | 96 | 4 | 25 | 0 | 2.4 | 1.6 | 0 |
| Styrene Acrylic Resin Production Example 7 | Styrene acrylic resin 7 | 81.5 | 100 | — | 14.3 | 2.4 | 1.8 | 0 |
| Styrene Acrylic Resin Production Example 8 | Styrene acrylic resin 8 | 92.6 | 20 | — | 0 | 5 | 2.4 | 0 |

TABLE 1-continued

| | | | | | | | | |
|---|---|---|---|---|---|---|---|---|
| Styrene Acrylic Resin Production Example 9 | Styrene acrylic resin 9 | 50.2 | 29.8 | 20 | 40.4 | 4.8 | 1.8 | 2.8 |

| Production Example | Tol2 amount (parts by mass) | Initial flow rate (parts by mass/h) | Final flow rate (parts by mass/h) | Polymerization method | PBD amount (parts by mass) | Tol3 amount (parts by mass) | Flow rate (parts by mass/h) |
|---|---|---|---|---|---|---|---|
| Styrene Acrylic Resin Production Example 1 | 21.5 | 8 | 12 | Multistage dropping polymerization | 7.6 | 32.4 | 10 |
| Styrene Acrylic Resin Production Example 2 | 32 | 8 | 12 | Multistage dropping polymerization | 9.2 | 30.8 | 10 |
| Styrene Acrylic Resin Production Example 3 | 35.8 | 8 | 12 | Multistage dropping polymerization | 7.6 | 32.4 | 10 |
| Styrene Acrylic Resin Production Example 4 | 10.6 | 10 | 10 | Dropping polymerization | 5.4 | 34.6 | 10 |
| Styrene Acrylic Resin Production Example 5 | 31 | 15 | 15 | Dropping polymerization | 2.8 | 27.2 | 10 |
| Styrene Acrylic Resin Production Example 6 | 56 | 13 | 17 | Multistage dropping polymerization | 14.2 | 25.8 | 10 |
| Styrene Acrylic Resin Production Example 7 | 0 | — | — | Solution polymerization | 7.2 | 0 | — |
| Styrene Acrylic Resin Production Example 8 | 0 | — | — | Solution polymerization | 1.2 | 0 | — |
| Styrene Acrylic Resin Production Example 9 | 10.2 | 15 | 15 | Dropping polymerization | 5.4 | 34.6 | 10 |

TABLE 2

| | Tg (° C.) | Mw | Mn | Mw/Mn | Mp | Mp/Mw | Acid value (mgKOH/g) | Hydroxyl value (mgKOH/g) | Content of THF soluble matter (mass %) | Content of methanol insoluble matter (mass %) |
|---|---|---|---|---|---|---|---|---|---|---|
| Styrene acrylic resin 1 | 68.5 | 14,200 | 6,800 | 2.09 | 15,500 | 1.09 | 9.8 | 5.6 | 100.0 | 96.9 |
| Styrene acrylic resin 2 | 84.2 | 8,400 | 3,600 | 2.33 | 10,200 | 1.21 | 13.1 | 2.4 | 100.0 | 97.3 |
| Styrene acrylic resin 3 | 93.1 | 14,300 | 4,900 | 2.92 | 14,700 | 1.03 | 14.1 | 0.0 | 100.0 | 98.8 |
| Styrene acrylic resin 4 | 59.3 | 50,800 | 14,600 | 3.48 | 46,300 | 0.91 | 7.2 | 12.5 | 96.7 | 95.7 |
| Styrene acrylic resin 5 | 97.6 | 101,200 | 38,200 | 2.65 | 96,100 | 0.95 | 18.3 | 0.0 | 94.8 | 93.2 |
| Styrene acrylic resin 6 | 54.4 | 3,400 | 1,600 | 2.13 | 3,800 | 1.12 | 8.9 | 0.0 | 100.0 | 89.8 |
| Styrene acrylic resin 7 | 66.1 | 16,300 | 3,100 | 5.26 | 4,200 | 0.26 | 9.2 | 9.1 | 91.7 | 83.9 |
| Styrene acrylic resin 8 | 102.7 | 310,700 | 42,300 | 7.35 | 68,700 | 0.22 | 11.2 | 10.6 | 83.6 | 89.7 |
| Styrene acrylic resin 9 | 29.7 | 61,100 | 12,800 | 4.77 | 43,600 | 0.71 | 7.1 | 12.3 | 96.8 | 88.6 |

Sulfonic Acid-Based Resin Production Example 1

The following materials were loaded into a reaction vessel provided with a reflux condenser, a stirring machine, and a nitrogen-introducing pipe under a nitrogen atmosphere, and were heated in an oil bath at 70° C.

| | |
|---|---|
| Methanol: | 60 parts by mass |
| Tetrahydrofuran: | 200 parts by mass |

While the contents in the above vessel were stirred at 200 revolutions per minute, a mixture of the following materials was dropped to the vessel over 2 hours.

| | |
|---|---|
| Styrene: | 65 parts by mass |
| n-butyl acrylate: | 25 parts by mass |

-continued

| | |
|---|---|
| Acrylic acid: | 10 parts by mass |
| Di-t-butyl peroxide (PBD): | 3.5 parts by mass |

The resultant mixture was polymerized for an additional ten hours. The solvent was removed by distillation, and the solid was pulverized. After that, the pulverized products were dried in a vacuum dryer at 40° C. As a result, a main-chain resin was obtained.

The following materials were loaded into a reaction vessel provided with a reflux condenser, a stirring machine, and a nitrogen-introducing pipe under a nitrogen atmosphere.

| | |
|---|---|
| Main-chain resin obtained above: | 100 parts by mass |
| 2-aminobenzenesulfonic acid: | 110 parts by mass |
| Pyridine: | 400 parts by mass |

While the contents in the above vessel were stirred at 200 revolutions per minute, 420 parts by mass of triphenyl phosphite were added to the vessel, and the mixture was heated at 120° C. for 6 hours. After the completion of the reaction, the above reaction liquid was charged into 700 parts by mass of methanol stirred at 200 revolutions per minute, and the precipitate was recovered. The resultant precipitate was repeatedly washed with each of 1-mol/l hydrochloric acid and deionized water three times. The washed product was dried in a vacuum dryer at 40° C. As a result, a sulfonic group-containing styrene acrylic resin was obtained.

Next, the following material was loaded into a reaction vessel provided with a reflux condenser, a stirring machine, and a nitrogen-introducing pipe under a nitrogen atmosphere, and was heated in an oil bath at 80° C.

| | |
|---|---|
| Trimethyl orthoformate: | 400 parts by mass |

While the content in the above vessel was stirred at 200 revolutions per minute, 100 parts by mass of the sulfonic group-containing styrene acrylic resin obtained in the foregoing were added to the vessel over 30 minutes, and the mixture was stirred for an additional twelve hours. The above reaction liquid was charged into 5,000 parts by mass of methanol stirred at 200 revolutions per minute, and the precipitate was recovered. The precipitate was repeatedly washed with each of methanol and deionized water three times, and was then dried in a vacuum. As a result, a sulfonic acid-based resin 1 having a sulfonic acid methyl ester group was obtained. Table 3-1 shows the physical properties of the sulfonic acid-based resin 1, and Table 3-2 shows the structure of the sulfonic acid-based resin 1.

Sulfonic Acid-Based Resin Production Example 2

The following materials were loaded into a reaction vessel provided with a reflux condenser, a stirring machine, and a nitrogen-introducing pipe under a nitrogen atmosphere.

| | |
|---|---|
| Methanol: | 240 parts by mass |
| 2-butanone: | 140 parts by mass |
| 2-propanol: | 100 parts by mass |
| Styrene: | 77 parts by mass |
| 2-ethylhexyl acrylate: | 15 parts by mass |
| 2-acrylamide-2-methylpropanesulfonic acid: | 8 parts by mass |

The contents in the vessel were stirred at 200 revolutions per minute, and were heated to 80° C. A solution prepared by diluting 1 part by mass of t-butylperoxy-2-ethylhexanoate as a polymerization initiator with 30 parts by mass of 2-butanone was dropped to the vessel over 30 minutes, and the mixture was continuously stirred for 5 hours. Further, the solution prepared by diluting 1 part by mass of t-butylperoxy-2-ethylhexanoate with 30 parts by mass of 2-butanone was dropped to the vessel over 30 minutes, and the resultant mixture was polymerized by being stirred for an additional 5 hours. While the temperature was maintained, 500 parts by mass of deionized water were silently added to the vessel, and the resultant mixture was stirred at 80 revolutions per minute for 2 hours to such an extent that an interface between an organic layer and a water layer was not disturbed. After the resultant had been left at rest for 1 hour, the water layer was removed. The organic layer was repeatedly washed with deionized water three times, and then 20 parts by mass of anhydrous sodium sulfate were added to the remaining organic layer. After the mixture had been filtrated with a qualitative filter paper No. 2 (manufactured by Advantec Toyo Kaisha, Ltd.), the solvent was removed by distillation. The remainder was dried in a vacuum dryer at 40° C. As a result, a sulfonic acid-based resin 2 having a sulfonic group was obtained. Table 3-1 shows the physical properties of the resultant sulfonic acid-based resin 2, and Table 3-2 shows the structure of the sulfonic acid-based resin 2.

TABLE 3-1

| Sulfonic Acid-based Resin Production Example | Resin | Tg (° C.) | Mw | Mn | Mw/Mn | Mp | Acid value |
|---|---|---|---|---|---|---|---|
| Sulfonic Acid-based Resin Production Example 1 | Sulfonic acid-based resin 1 | 51 | 8,900 | 4,300 | 2.07 | 9,100 | 7.6 |
| Sulfonic Acid-based Resin Production Example 2 | Sulfonic acid-based resin 2 | 62 | 32,400 | 11,200 | 2.89 | 16,700 | 16.8 |

TABLE 3-2

| Sulfonic Acid-based Resin Production Example | Resin | Sulfonic group, sulfonate group, or sulfonic acid ester group | Sulfur content (mass %) |
|---|---|---|---|
| Sulfonic Acid-based Resin Production Example 1 | Sulfonic acid-based resin 1 | 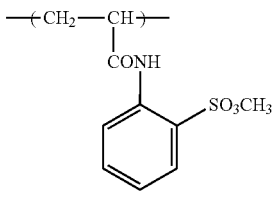 | 2.16 |
| Sulfonic Acid-based Resin Production Example 2 | Sulfonic acid-based resin 2 | 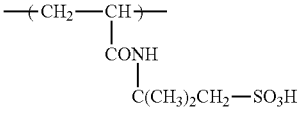 | 1.32 |

Example 1

Step of Forming Monomer Composition

| | |
|---|---|
| Styrene (St): | 70 parts by mass |
| N-butyl acrylate (Ba): | 30 parts by mass |
| Pigment blue 15:3: | 8 parts by mass |
| Aluminum salicylate compound (BONTRON E-88: manufactured by Orient Chemical Industries Co., Ltd.): | 0.5 part by mass |
| Above styrene acrylic resin 1: | 18 parts by mass |
| Above sulfonic acid-based resin 1: | 3.5 parts by mass |
| Divinylbenzene (DVB): | 0.9 part by mass |
| Wax (HNP-10: manufactured by NIPPON SEIRO CO., LTD.): | 10 parts by mass |

First, a mixture of the above materials was prepared. Next, 15-mm ceramic beads were loaded into the mixture, and were then dispersed with an attritor for 3 hours. Then, the beads were removed. As a result, a monomer composition was obtained.

(Step of Forming Water Dispersion Liquid of Dispersant)

First, 700 parts by mass of ion-exchanged water and 450 parts by mass of a 0.1-mol/l aqueous solution of $Na_3PO_4$ were charged into a reaction vessel provided with a condenser, a stirring machine, and a nitrogen-introducing pipe, and the mixture was heated to 70° C. The mixture was stirred with a TK-HOMOMIXER (manufactured by Tokushu Kika Kogyo) at 10,000 rpm under a nitrogen atmosphere. Then, 70 parts by mass of a 1.0-mol/l aqueous solution of $CaCl_2$ were added to the mixture. As a result, a water dispersion liquid containing calcium phosphate was obtained.

(Step of Granulating Monomer Composition)

The monomer composition was loaded into the above water dispersion liquid under a nitrogen atmosphere. The mixture was granulated with the TK-HOMOMIXER at 12,000 rpm for 6 minutes. After a lapse of 3 minutes from the loading of the monomer composition, 15 parts by mass of a solution of an initiator 1 shown in Table 4 in toluene were added to the mixture.

(Polymerizing Step)

The resultant mixture was polymerized in an oil bath having a temperature of 90° C. under a nitrogen atmosphere at 150 rpm for 12 hours with the stirring machine changed from a high-speed stirring machine to a propeller stirring blade. After that, the resultant was cooled to a temperature of 30° C. at a cooling rate of 0.1° C./min.

(Washing/Drying Step)

While the above water dispersion liquid was stirred at 150 rpm, hydrochloric acid was charged into the water dispersion liquid to adjust the pH of the water dispersion liquid to 1.5. After having been stirred for 2 hours without being treated, the resultant was repeatedly subjected to each of filtration and water washing three times. The solid was recovered by the filtration, and was then dried in a vacuum dryer at a temperature of 40° C. for 1 day. As a result, toner particles 1 were obtained.

(External Addition Step)

Next, the following materials were mixed with a HENSCHEL mixer. As a result, Toner 1 was obtained.

| | |
|---|---|
| Toner particles 1 described above: | 100 parts by mass |
| Hydrophobic titanium oxide treated with $n\text{-}C_4H_9Si(OCH_3)_3$ (having a BET specific surface area of 120 $m^2/g$): | 0.8 part by mass |
| Hydrophobic silica treated with hexamethyldisilazane and then with silicone oil (having a BET specific surface area of 180 $m^2/g$): | 0.8 part by mass |

Tables 6-1 and 6-2 show the physical properties of Toner 1. Toner 1 was subjected to performance evaluations to be described later. Table 7 shows the results of the performance evaluations of Toner 1.

Examples 2 to 6, and Comparative Examples 2, 4, 6 to 8, 10, and 11

Toners 2 to 6, 10, 12, 14 to 16, 18, and 19 were each obtained in the same manner as in Example 1 except that the kinds and amounts of usage of raw materials, and a reaction temperature in Example 1 were changed to conditions shown in Tables 5-1 and 5-2. Tables 6-1 and 6-2 show the physical properties of Toners 2 to 6, 10, 12, 14 to 16, 18, and 19. Toners 2 to 6, 10, 12, 14 to 16, 18, and 19 were each subjected to the performance evaluations in the same manner as in Example 1. Table 7 shows the results of the performance evaluations of Toners 2 to 6, 10, 12, 14 to 16, 18, and 19.

Example 7

Toner 7 was obtained in the same manner as in Example 1 except that the kinds and amounts of usage of raw materials, the time point at which an initiator was loaded, and a reaction temperature in Example 1 were changed to conditions shown in Tables 5-1 and 5-2, and the polymerization initiator was loaded simultaneously with the loading of a monomer composition in the step of granulating the monomer composition in Example 1. Tables 6-1 and 6-2 show the physical properties of Toner 7. Toner 7 was subjected to the performance evaluations in the same manner as in Example 1. Table 7 shows the results of the performance evaluations of Toner 7.

Example 8, and Comparative Examples 1, 3, and 9

Toners 8, 9, 11, and 17 were each obtained in the same manner as in Example 7 except that the kinds and amounts of usage of raw materials, and a reaction temperature in Example 7 were changed to conditions shown in Tables 5-1 and 5-2. Tables 6-1 and 6-2 show the physical properties of Toners 8, 9, 11, and 17. Toners 8, 9, 11, and 17 were each subjected to the performance evaluations in the same manner as in Example 1. Table 7 shows the results of the performance evaluations of Toners 8, 9, 11, and 17.

Comparative Example 5

A dispersion liquid of core particles was obtained in the same manner as in Example 1 except that: the styrene acrylic resin 1 was not added in the step of forming a monomer composition in Example 1; and the resultant was held at 90° C. without being cooled after the completion of the polymerization in the polymerizing step in Example 1.

| | |
|---|---|
| Styrene: | 16.3 parts by mass (81.5 mass %) |
| n-butyl acrylate: | 2.86 parts by mass (14.3 mass %) |
| Methyl methacrylate: | 0.48 part by mass (2.4 mass %) |
| Methacrylic acid: | 0.36 part by mass (1.8 mass %) |

A mixture of the above compounds and 0.35 part by mass of 2,2'-azobis (2-methyl-N-(2-hydroxyethyl))propionamide (VA-086 manufactured by Wako Pure Chemical Industries, Ltd.) dissolved in 35 parts by mass of ion-exchanged water were simultaneously dropped to the dispersion liquid of the core particles over time periods of 30 minutes each. The mixture was continuously polymerized for 5 hours without being treated, and then the resultant was cooled to room temperature.

Toner 13 was obtained in the same manner as in the washing/drying step and the external addition step in Example 1. Tables 6-1 and 6-2 show the physical properties of Toner: 13. Toner 13 was subjected to the performance evaluations in the same manner as in Example 1. Table 7 shows the results of the performance evaluations of Toner 13.

TABLE 4

| | Initiator | 10-hour half-life temperature (° C.) | Molecular weight | Theoretical active oxygen content (%) | State |
|---|---|---|---|---|---|
| Initiator 1 | t-butyl peroxypivalate | 54.6 | 174 | 9.2 | 40% toluene solution |
| Initiator 2 | t-butyl peroxyneodecanoate | 46.4 | 244 | 6.6 | 60% toluene solution |
| Initiator 3 | 1,1,3,3-tetramethyl butylperoxy-2-ethyl hexanoate | 65.3 | 272 | 5.9 | 80% toluene solution |
| Initiator 4 | Benzoyl peroxide | 73.6 | 242 | 6.6 | Powder containing 50% of water |
| Initiator 5 | 2,2'-azobis(2,4-dimethyl-valeronitrile) | 51 | 248 | — | Powder |

TABLE 5-1

| | | | | | Wax | | Styrene acrylic resin | |
|---|---|---|---|---|---|---|---|---|
| Example | Toner | St amount (parts by mass) | Ba amount (parts by mass) | DVB amount (parts by mass) | Kind | Addition amount (parts by mass) | Kind | Addition amount (parts by mass) |
| Example 1 | Toner 1 | 70 | 30 | 0.9 | HNP10(manufactured by NIPPON SEIRO CO., LTD.) | 10 | Styrene acrylic resin 1 | 18 |
| Example 2 | Toner 2 | 70 | 30 | 1.2 | HNP10(manufactured by NIPPON SEIRO CO., LTD.) | 10 | Styrene acrylic resin 2 | 24 |
| Example 3 | Toner 3 | 70 | 30 | 1.0 | HNP10(manufactured by NIPPON SEIRO CO., LTD.) | 10 | Styrene acrylic resin 3 | 16 |
| Example 4 | Toner 4 | 70 | 30 | 0.8 | HNP10(manufactured by NIPPON SEIRO CO., LTD.) | 10 | Styrene acrylic resin 4 | 24 |
| Example 5 | Toner 5 | 85 | 15 | 0.6 | HNP10(manufactured by NIPPON SEIRO CO., LTD.) | 10 | Styrene acrylic resin 5 | 16 |
| Example 6 | Toner 6 | 65 | 35 | 0.8 | HNP9(manufactured by NIPPON SEIRO CO., LTD.) | 6 | Styrene acrylic resin 6 | 36 |
| Example 7 | Toner 7 | 65 | 35 | 0.6 | Purified carnauba No. 1 | 14 | Styrene acrylic resin 5 | 24 |
| Example 8 | Toner 8 | 80 | 20 | 1.6 | FT100(manufactured by NIPPON SEIRO CO., LTD.) | 4 | Styrene acrylic resin 3 | 8 |
| Comparative Example 1 | Toner 9 | 70 | 30 | 1.0 | HNP10(manufactured by NIPPON SEIRO CO., LTD.) | 10 | Styrene acrylic resin 7 | 18 |
| Comparative Example 2 | Toner 10 | 70 | 30 | 0.8 | HNP10(manufactured by NIPPON SEIRO CO., LTD.) | 10 | Styrene acrylic resin 8 | 16 |
| Comparative Example 3 | Toner 11 | 85 | 15 | 1.0 | Purified carnauba No. 1 | 14 | Styrene acrylic resin 5 | 4 |
| Comparative Example 4 | Toner 12 | 65 | 35 | 0.2 | HNP10(manufactured by NIPPON SEIRO CO., LTD.) | 10 | Styrene acrylic resin 6 | 24 |
| Comparative Example 5 | Toner 13 | 70 | 30 | 1.0 | HNP10(manufactured by NIPPON SEIRO CO., LTD.) | 10 | Seed polymerization of composition of styrene acrylic resin 1 | (Corre-sponding to 20 parts by mass) |
| Comparative Example 6 | Toner 14 | 55 | 45 | 0.8 | HNP9(manufactured by NIPPON SEIRO CO., LTD.) | 10 | Styrene acrylic resin 9 | 18 |
| Comparative Example 7 | Toner 15 | 60 | 40 | 3.6 | FT100(manufactured by NIPPON SEIRO CO., LTD.) | 10 | Styrene acrylic resin 3 | 32 |
| Comparative Example 8 | Toner 16 | 95 | 5 | 1.0 | FT100(manufactured by NIPPON SEIRO CO., LTD.) | 10 | Styrene acrylic resin 1 | 24 |
| Comparative Example 9 | Toner 17 | 92 | 8 | 0.2 | HNP10(manufactured by NIPPON SEIRO CO., LTD.) | 10 | Styrene acrylic resin 5 | 16 |

TABLE 5-1-continued

| Example | Toner | St amount (parts by mass) | Ba amount (parts by mass) | DVB amount (parts by mass) | Wax Kind | Wax Addition amount (parts by mass) | Styrene acrylic resin Kind | Styrene acrylic resin Addition amount (parts by mass) |
|---|---|---|---|---|---|---|---|---|
| Comparative Example 10 | Toner 18 | 50 | 50 | 1.0 | HNP9(manufactured by NIPPON SEIRO CO., LTD.) | 6 | Styrene acrylic resin 6 | 42 |
| Comparative Example 11 | Toner 19 | 65 | 35 | 0.8 | FT100(manufactured by NIPPON SEIRO CO., LTD.) | 4 | Styrene acrylic resin 9 | 16 |

TABLE 5-2

| Example | Sulfonic acid-based resin Resin | Sulfonic acid-based resin Addition amount (parts by mass) | Initiator Compound | Initiator Addition amount (parts by mass) | Initiator Loading time | Reaction temperature (° C.) |
|---|---|---|---|---|---|---|
| Example 1 | Sulfonic acid-based resin 1 | 3.5 | Initiator 1 | 15 | 3 minutes after initiation of granulation | 90 |
| Example 2 | Sulfonic acid-based resin 1 | 3.5 | Initiator 1 | 20 | 3 minutes after initiation of granulation | 90 |
| Example 3 | Sulfonic acid-based resin 2 | 4.0 | Initiator 1 | 25 | 3 minutes after initiation of granulation | 90 |
| Example 4 | Sulfonic acid-based resin 2 | 4.0 | Initiator 1 | 25 | 3 minutes after initiation of granulation | 90 |
| Example 5 | Sulfonic acid-based resin 2 | 3.5 | Initiator 1 | 10 | 3 minutes after initiation of granulation | 90 |
| Example 6 | Sulfonic acid-based resin 2 | 3.0 | Initiator 2 | 30 | 3 minutes after initiation of granulation | 95 |
| Example 7 | Sulfonic acid-based resin 2 | 4.0 | Initiator 2 | 15 | Simultaneously with initiation of granulation | 95 |
| Example 8 | — | — | Initiator 3 | 30 | Simultaneously with initiation of granulation | 85 |
| Comparative Example 1 | Sulfonic acid-based resin 1 | 3.5 | Initiator 1 | 15 | Simultaneously with initiation of granulation | 90 |
| Comparative Example 2 | — | — | Initiator 4 | 25 | 3 minutes after initiation of granulation | 90 |
| Comparative Example 3 | — | — | Initiator 5 | 4 | Simultaneously with initiation of granulation | 70 |
| Comparative Example 4 | Sulfonic acid-based resin 2 | 1.5 | Initiator 5 | 25 | 3 minutes after initiation of granulation | 90 |
| Comparative Example 5 | Sulfonic acid-based resin 1 | 3.5 | Initiator 1 | 30 | 3 minutes after initiation of granulation | 90 |
| Comparative Example 6 | Sulfonic acid-based resin 1 | 3.5 | Initiator 3 | 7 | 3 minutes after initiation of granulation | 85 |
| Comparative Example 7 | Sulfonic acid-based resin 1 | 10.0 | Initiator 2 | 30 | 3 minutes after initiation of granulation | 95 |
| Comparative Example 8 | Sulfonic acid-based resin 1 | 3.5 | Initiator 1 | 20 | 3 minutes after initiation of granulation | 90 |
| Comparative Example 9 | Sulfonic acid-based resin 2 | 3.5 | Initiator 3 | 30 | Simultaneously with initiation of granulation | 85 |
| Comparative Example 10 | Sulfonic acid-based resin 2 | 3.0 | Initiator 3 | 30 | 3 minutes after initiation of granulation | 90 |
| Comparative Example 11 | — | — | Initiator 1 | 20 | 3 minutes after initiation of granulation | 90 |

TABLE 6-1

| Toner | Particle diameter D4 (μm) | Particle diameter D1 (μm) | Particle diameter D4/D1 | Flow-type particle image Average circularity | Flow-type particle image Standard deviation | Dynamic viscoelasticity Ta (° C.) | Dynamic viscoelasticity G'a | Dynamic viscoelasticity Tb (° C.) | Dynamic viscoelasticity Ta − Tb (° C.) | Dynamic viscoelasticity G'b | Dynamic viscoelasticity G'a − G'b | Dynamic viscoelasticity G'1Ta (Pa) |
|---|---|---|---|---|---|---|---|---|---|---|---|---|
| Toner 1 | 5.2 | 4.8 | 1.08 | 0.989 | 0.014 | 104.2 | 13.3 | 56.2 | 48 | 6.6 | 6.7 | 9,310 |
| Toner 2 | 5.3 | 4.7 | 1.13 | 0.988 | 0.015 | 111.7 | 10.7 | 58.7 | 53 | 5.8 | 4.9 | 16,670 |
| Toner 3 | 5.2 | 4.5 | 1.16 | 0.988 | 0.015 | 123.9 | 9.1 | 65.1 | 58.8 | 7.5 | 1.6 | 2,430 |
| Toner 4 | 5.5 | 4.7 | 1.17 | 0.984 | 0.019 | 88.3 | 8.3 | 53.4 | 34.9 | 4.9 | 3.4 | 32,600 |
| Toner 5 | 5.8 | 4.7 | 1.23 | 0.978 | 0.023 | 128.7 | 6.8 | 73.8 | 54.9 | 5.7 | 1.1 | 82,800 |
| Toner 6 | 4.9 | 4 | 1.23 | 0.977 | 0.026 | 74.1 | 6.1 | 52.3 | 21.8 | 4.7 | 1.4 | 315,200 |
| Toner 7 | 6.1 | 4.8 | 1.27 | 0.974 | 0.031 | 132.6 | 5.6 | 51.4 | 81.2 | 5.8 | −0.2 | 560 |
| Toner 8 | 4.8 | 3.8 | 1.26 | 0.973 | 0.037 | 125.5 | 6.3 | 75.2 | 50.3 | 5.9 | 0.4 | 127,400 |
| Toner 9 | 5.7 | 4.5 | 1.27 | 0.978 | 0.026 | 110.3 | 4.6 | 54.2 | 56.1 | 5.7 | −1.1 | 1,840 |
| Toner 10 | 6.1 | 4.7 | 1.30 | 0.972 | 0.041 | 151.2 | 4.4 | 62.3 | 88.9 | 7.2 | −2.8 | 430 |
| Toner 11 | 5.1 | 3.9 | 1.31 | 0.979 | 0.024 | 108.3 | 3.8 | 72.9 | 35.4 | 7.4 | −3.6 | 67,610 |
| Toner 12 | 5.4 | 4.3 | 1.26 | 0.971 | 0.046 | 63.4 | 4.2 | 48.6 | 14.8 | 5.4 | −1.2 | 1,224,300 |
| Toner 13 | 6.7 | 4.7 | 1.43 | 0.976 | 0.028 | — | — | 49.2 | — | 5.2 | — | — |
| Toner 14 | 8.3 | 6.2 | 1.34 | 0.976 | 0.025 | 58.3 | 5.4 | 34.4 | 23.9 | 5.2 | 0.2 | 182,100 |
| Toner 15 | 7.2 | 5.6 | 1.29 | 0.982 | 0.019 | 134.1 | 17.4 | 41.5 | 92.6 | 6.1 | 11.3 | 1,680 |
| Toner 16 | 5.3 | 4.6 | 1.15 | 0.983 | 0.017 | 105.2 | 7.3 | 86.1 | 19.1 | 4.9 | 2.4 | 529,300 |
| Toner 17 | 5.3 | 4.2 | 1.26 | 0.974 | 0.028 | 136.7 | 5.3 | 82.4 | 54.3 | 5.6 | −0.3 | 36,470 |

TABLE 6-1-continued

| Toner | Particle diameter D4 (μm) | D1 (μm) | D4/D1 | Flow-type particle image Average circularity | Standard deviation | Dynamic viscoelasticity Ta (° C.) | G'a | Tb (° C.) | Ta − Tb (° C.) | G'b | G'a − G'b | G'1Ta (Pa) |
|---|---|---|---|---|---|---|---|---|---|---|---|---|
| Toner 18 | 5.7 | 4.1 | 1.39 | 0.968 | 0.047 | 71.4 | 5.7 | 32.6 | 39.1 | 5.8 | −0.1 | 23,830 |
| Toner 19 | 8.2 | 6.1 | 1.34 | 0.972 | 0.027 | 62.2 | 5.1 | 48.1 | 14.1 | 5.9 | −0.8 | 981,300 |

TABLE 6-2

| Toner | DSC Tg (° C.) | Tm (° C.) | Endotherm (J/g) | GPC Mw | Mn | Mw/Mn | Mp | Soxhlet THF insoluble matter (mass %) | IPA soluble matter (mass %) | Fluorescent X-ray Sulfur amount (mass %) |
|---|---|---|---|---|---|---|---|---|---|---|
| Toner 1 | 50.6 | 75.6 | 7.2 | 62,400 | 7,480 | 8.3 | 14,800 | 7.2 | 22.8 | 0.112 |
| Toner 2 | 51.1 | 75.6 | 7.2 | 41,300 | 6,520 | 6.3 | 10,600 | 6.6 | 24.3 | 0.117 |
| Toner 3 | 54.4 | 75.5 | 7.3 | 91,600 | 8,230 | 11.1 | 9,100 | 5.6 | 19.6 | 0.094 |
| Toner 4 | 52.3 | 75.6 | 6.8 | 101,700 | 5,630 | 18.1 | 8,400 | 9.1 | 28.7 | 0.083 |
| Toner 5 | 64.6 | 75.7 | 7.7 | 233,800 | 11,370 | 20.6 | 22,300 | 10.7 | 13.7 | 0.064 |
| Toner 6 | 47.2 | 74.2 | 5.2 | 9,400 | 3,220 | 2.9 | 4,300 | 4.6 | 36.2 | 0.048 |
| Toner 7 | 46.1 | 82.4 | 12.2 | 97,300 | 7,860 | 12.4 | 17,200 | 5.2 | 33.1 | 0.084 |
| Toner 8 | 66.2 | 89.3 | 3.8 | 23,200 | 4,910 | 4.7 | 6,700 | 13.3 | 31.4 | — |
| Toner 9 | 50.3 | 75.5 | 6.4 | 38,200 | 8,930 | 4.3 | 12,900 | 11.2 | 26.1 | 0.114 |
| Toner 10 | 56.5 | 75.6 | 6.3 | 34,300 | 7,970 | 4.3 | 11,600 | 16.4 | 16.3 | — |
| Toner 11 | 67.1 | 82.2 | 13.4 | 146,300 | 33,600 | 4.4 | 41,200 | 35.6 | 8.9 | — |
| Toner 12 | 43.4 | 75.6 | 5.4 | 5,800 | 2,620 | 2.2 | 4,500 | 1.3 | 51.3 | 0.017 |
| Toner 13 | 44.7 | 75.6 | 6.2 | 32,600 | 5,810 | 5.6 | 7,800 | 1.6 | 56.4 | 0.038 |
| Toner 14 | 29.4 | 74.1 | 9.3 | 132,500 | 12,900 | 10.3 | 32,300 | 3.1 | 30.6 | 0.105 |
| Toner 15 | 36.3 | 89.2 | 9.1 | 153,000 | 5,410 | 28.3 | 6,700 | 41.2 | 33.2 | 0.334 |
| Toner 16 | 78.6 | 89.4 | 8.8 | 61,300 | 7,570 | 8.1 | 14,100 | 6.9 | 18.9 | 0.109 |
| Toner 17 | 75.2 | 75.5 | 6.3 | 43,700 | 4,820 | 9.1 | 6,600 | 2.4 | 41.2 | 0.058 |
| Toner 18 | 25.3 | 74.2 | 6.1 | 11,300 | 2,950 | 3.8 | 4,800 | 4.1 | 58.2 | 0.046 |
| Toner 19 | 41.2 | 89.3 | 3.7 | 34,800 | 4,960 | 7.0 | 9,800 | 3.6 | 36.1 | — |

<Methods of Evaluating Toner for Low-Temperature Fixability, Offset Resistance, Gloss Performance, and Penetration Resistance>

A commercially available color laser printer (LBP-5400, manufactured by Canon Inc.) was used. A toner was taken out of the cyan cartridge of the printer, and the toner of the present invention was loaded into the cartridge. Then, the cartridge was mounted on the cyan station of the printer. Next, an unfixed toner image (0.5 mg/cm$^2$) measuring 2.0 cm in its longitudinal direction by 15.0 cm in its horizontal direction was formed on image-receiving paper (Office Planner manufactured by Canon Inc., 64 g/m$^2$) at each of a portion at a distance of 2.0 cm from an upper end portion in a paper-passing direction and a portion at a distance of 2.0 cm from a lower end portion in the direction. Next, a fixing unit taken out of the commercially available color printer (LBP-5400, manufactured by Canon Inc.) was reconstructed so that its fixation temperature and process speed could be adjusted. A fixing test on the unfixed image was performed with the reconstructed unit. While the process speed was set to 240 mm/sec and a set temperature was changed in an increment of 5° C. in the range of 110° C. to 240° C. under normal temperature and normal humidity, the above toner image was fixed at each temperature. An evaluation for low-temperature fixability was performed on the basis of the temperature at which cold offset no longer occurred obtained by changing the temperature from a low temperature to a high temperature. In addition, evaluations for offset resistance, gloss performance, and penetration resistance were performed in accordance with the following evaluation criteria.

[Evaluation Criteria for Offset Resistance]

A: No hot offset occurs in a temperature region higher than the lowest temperature at which cold offset does not occur by 50° C. or more.

B: No hot offset occurs in a temperature region higher than the lowest temperature at which cold offset does not occur by 40° C. or more.

C: No hot offset occurs in a temperature region higher than the lowest temperature at which cold offset does not occur by 30° C. or more.

D: No hot offset occurs in a temperature region higher than the lowest temperature at which cold offset does not occur by 20° C. or more.

E: Hot offset occurs in a temperature region higher than the lowest temperature at which cold offset does not occur by less than 20° C.

[Evaluation Criteria for Gloss Performance]

The gloss value of a fixed image in which neither cold offset nor hot offset occurred was measured with a handy glossmeter "GLOSSMETER PG-3D" (manufactured by NIPPON DENSHOKU INDUSTRIES CO., LTD.) at an angle of incidence of light of 75°, and then the image was evaluated on the basis of the following criteria.

A: The maximum of the gloss value of a solid image portion is 35 or more.

B: The maximum of the gloss value of a solid image portion is 30 or more and less than 35.

C: The maximum of the gloss value of a solid image portion is 25 or more and less than 30.

D: The maximum of the gloss value of a solid image portion is 20 or more and less than 25.

E: The maximum of the gloss value of a solid image portion is less than 20.

[Evaluation Criteria for Penetration Resistance]

An evaluation for a rate of change [rate of change (%)=$(t_1-t_2)\times100/t_1$] between the gloss value ($t_1$) of an image when its gloss value became maximum and the gloss value ($t_2$) of an image created at a temperature higher than the temperature of a fixing unit when the above image was created by 10° C. was performed on the basis of the following criteria.

A: The rate of change between the gloss values is less than 5% (the toner is particularly excellent in penetration resistance).

B: The rate of change between the gloss values is 5% or more and less than 10% (the toner is excellent in penetration resistance).

C: The rate of change between the gloss values is 10% or more and less than 15% (the penetration resistance of the toner is at such a level that no problem arises).

D: The rate of change between the gloss values is 15% or more and less than 20% (the toner is somewhat poor in penetration resistance).

E: The rate of change between the gloss values is 20% or more (the toner is poor in penetration resistance).

ation for durable stability was performed in accordance with the following evaluation criteria.

(Evaluation Criteria for Durable Stability)

A: A solid image density becomes less than 1.5 after the toner has been added four times (the toner is particularly excellent in durable stability).

B: A solid image density becomes less than 1.5 after the toner has been added three times (the toner is good in durable stability).

C: A solid image density becomes less than 1.5 after the toner has been added twice (the durable stability of the toner is at an ordinary level).

D: A solid image density becomes less than 1.5 after the toner has been added once (the toner is somewhat poor in durable stability).

E: A solid image density becomes less than 1.5 without the addition of the toner (the toner is poor in durable stability).

TABLE 7

| | | Toner performance | | | | |
|---|---|---|---|---|---|---|
| Example | Toner | Low-temperature fixability | Offset resistance | Gloss performance | Penetration resistance | Durable stability |
| Example 1 | Toner 1 | 120° C. | A | A | A | A |
| Example 2 | Toner 2 | 125° C. | B | A | B | A |
| Example 3 | Toner 3 | 130° C. | A | B | A | A |
| Example 4 | Toner 4 | 120° C. | B | B | B | B |
| Example 5 | Toner 5 | 140° C. | A | C | A | B |
| Example 6 | Toner 6 | 125° C. | C | A | C | C |
| Example 7 | Toner 7 | 130° C. | B | B | C | C |
| Example 8 | Toner 8 | 135° C. | B | C | A | C |
| Comparative Example 1 | Toner 9 | 125° C. | C | B | D | D |
| Comparative Example 2 | Toner 10 | 145° C. | B | D | B | E |
| Comparative Example 3 | Toner 11 | 135° C. | A | E | B | D |
| Comparative Example 4 | Toner 12 | 120° C. | E | C | D | E |
| Comparative Example 5 | Toner 13 | 135° C. | D | C | D | E |
| Comparative Example 6 | Toner 14 | 115° C. | D | C | E | E |
| Comparative Example 7 | Toner 15 | 130° C. | B | E | A | D |
| Comparative Example 8 | Toner 16 | 160° C. | A | D | A | B |
| Comparative Example 9 | Toner 17 | 155° C. | C | C | C | D |
| Comparative Example 10 | Toner 18 | 120° C. | D | B | E | E |
| Comparative Example 11 | Toner 19 | 120° C. | C | C | D | E |

<Evaluation of Toner for Durable Stability>

A commercially available color laser printer (LBP-5400, manufactured by Canon Inc.) was used, and was reconstructed so that the temperature of its fixing unit could be changed. A correlation between the temperature of the fixing unit and the gloss value of each toner was determined in advance in the same manner as in the above evaluation for gloss performance. Then, the temperature of the fixing unit was set to the temperature at which the gloss value of each toner became maximum, and the following evaluation was performed. A toner was taken out of the cyan cartridge of the printer, and 50 g of the toner of the present invention were loaded into the cartridge. The cartridge was left at rest under an environment having a temperature of 35° C. and a humidity of 90% RH for 14 days. Separately, the toner of the present invention was left at rest under an environment having a temperature of 35° C. and a humidity of 90% RH for 14 days. The above cartridge was mounted on the cyan station of the printer, and continuous printing was performed at a print percentage of 1% on image-receiving paper (Office Planner manufactured by Canon Inc., 64 g/m$^2$) under the condition that a solid image was formed at a ratio of once every 500 sheets. When the amount of the toner in the cartridge became 25 g or less, 20 g of the above toner that had been left at rest were added, and the continuous printing was similarly performed, that is, the above operation was repeated. An evalu- While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-260351, filed Oct. 7, 2008, which is hereby incorporated by reference herein in its entirety.

What is claimed is:

1. A toner, comprising:

toner particles each comprising at least a binder resin, a colorant, and a wax; and inorganic fine particles, wherein:

the toner has a local maximum A at a temperature of 60.0 to 135.0° C. and a local maximum B at a temperature of 35.0 to 85.0° C. in a (temperature-G'10/G'1) curve created by plotting a ratio (G'10/G'1) between a storage elastic modulus (G'1) at a frequency of 1 Hz and a storage elastic modulus (G'10) at a frequency of 10 Hz on a y axis and a temperature (° C.) at which the storage elastic moduli are measured on an x axis; and when a temperature at which the curve shows the local maximum A is represented by Ta (° C.) and a temperature at which the curve shows the local maximum B is represented by Tb (° C.), the Ta (° C.) is higher than the Tb (° C.), and a difference (Ta−Tb) (° C.) between the Ta (° C.) and the Tb (° C.) is 15.0 to 90.0° C., and a value (G'a) for the G'10/G'1 at the Ta (° C.) is 5.0 or more.

2. A toner according to claim 1, wherein each of the toner particles has a core-shell structure, and the toner has a difference (G'a−G'b) between a value (G'b) for the G'10/G'1 at the Tb (° C.) and the G'a of 1.0 to 15.0.

3. A toner according to claim 1, wherein the toner has a value (G'1Ta) for the G'1 at the Ta (° C.) of 1,000 to 300,000 Pa.

4. A toner according to claim 1, wherein, in a molecular weight distribution in terms of polystyrene obtained by gel permeation chromatography for tetrahydrofuran soluble matter of the toner, the toner has a peak molecular weight (Mp) at a molecular weight of 5,000 to 30,000, a weight-average molecular weight (Mw) of 6,000 to 200,000, and a ratio (Mw/Mn) between the weight-average molecular weight (Mw) and a number-average molecular weight (Mn) of 3.0 to 20.0.

5. A toner according to claim 1, wherein the toner contains tetrahydrofuran insoluble matter obtained by a Soxhlet extraction method, and a content of the tetrahydrofuran insoluble matter is 5.0 to 35.0 mass % with respect to the toner.

6. A toner according to claim 1, wherein the toner contains tetrahydrofuran soluble matter obtained by a Soxhlet extraction method, and a content of a sulfur element originating from sulfonic groups obtained by fluorescent X-ray measurement for the tetrahydrofuran soluble matter is 0.005 to 0.300 mass % with respect to a content of the tetrahydrofuran soluble matter.

* * * * *